US010932966B2

(12) United States Patent
Ledet et al.

(10) Patent No.: US 10,932,966 B2
(45) Date of Patent: Mar. 2, 2021

(54) WHEELCHAIR

(71) Applicant: Center for Disability Services, Albany, NY (US)

(72) Inventors: Eric H. Ledet, Guilderland, NY (US); Colleen P. Healey, Franklin, NY (US); Joshua M. Peterson, East Longmeadow, MA (US)

(73) Assignee: Center for Disability Services, Albany, NY (US)

( * ) Notice: Subject to any disclaimer, the term of this patent is extended or adjusted under 35 U.S.C. 154(b) by 19 days.

(21) Appl. No.: 15/712,724

(22) Filed: Sep. 22, 2017

(65) Prior Publication Data

US 2018/0110663 A1 Apr. 26, 2018

Related U.S. Application Data

(60) Provisional application No. 62/398,595, filed on Sep. 23, 2016.

(51) Int. Cl.
*A61G 5/10* (2006.01)
*A61G 7/057* (2006.01)

(52) U.S. Cl.
CPC ..... *A61G 5/1045* (2016.11); *A61G 5/1056* (2013.01); *A61G 7/05707* (2013.01)

(58) Field of Classification Search
CPC ..... A61G 5/1045; A61G 5/1056; A61G 7/057
USPC ..... 297/452.28
See application file for complete search history.

(56) References Cited

U.S. PATENT DOCUMENTS 3,081,129 A * 3/1963 Ridder ..... A47C 23/002 297/452.28 X
4,347,213 A * 8/1982 Rogers, Jr. ..... A47C 7/46 297/452.28 X
5,154,185 A 10/1992 Latimer et al.
6,217,121 B1 * 4/2001 Mollet ..... A47C 23/002 297/452.21
6,676,215 B1 1/2004 Shah et al.
7,931,257 B2 * 4/2011 VanDeRiet ..... A47C 7/027 267/142

(Continued)

FOREIGN PATENT DOCUMENTS

WO WO-9717930 A1 * 5/1997 ..... A61G 7/0573

OTHER PUBLICATIONS

USPTO (ISA/US), International Search Report and Written Opinion from PCT International Appl. No. PCT/US2017/52937, dated Dec. 15, 2017.

*Primary Examiner* — Anthony D Barfield
(74) *Attorney, Agent, or Firm* — Barclay Damon LLP

(57) ABSTRACT

A wheelchair is provided. The wheelchair includes supports for supporting a user. The supports are configured to reduce or prevent ischemia or pressure sores of the user. In another aspect, a system of supports for supporting a user is presented. A group of the supports is arranged along the perimeter of the shape. At least some of the group of the supports have different vertical positions. In another aspect, the supports are arranged as a repeating pattern of shapes, the individual supports being peripherally disposed along perimeters of the shapes. The repeating pattern of shapes includes a first shape overlapping with a second shape, and some of the individual supports are disposed along perimeters of both the first and second shapes.

5 Claims, 29 Drawing Sheets

(56) References Cited

U.S. PATENT DOCUMENTS

| | | | | |
|---|---|---|---|---|
| 8,177,302 | B2 * | 5/2012 | Carlson | A61G 5/1043<br>297/452.24 X |
| 2002/0027384 | A1 | 3/2002 | Zur | |
| 2004/0226102 | A1 | 11/2004 | Hampton et al. | |
| 2011/0171420 | A1 * | 7/2011 | Yang | A41D 13/0156<br>428/116 |
| 2013/0180531 | A1 | 7/2013 | Choi et al. | |
| 2016/0037939 | A1 | 2/2016 | Petrov | |

* cited by examiner

WHEELCHAIR

BACKGROUND

The subject matter disclosed herein relates to support systems, such as patient dynamic support systems for wheelchairs or beds, that are designed to prevent ischemia or pressure sores, or general purpose support systems used by people who sit for a long time such as truck drivers, pilots, etc. When a person is bedridden or is confined to a wheelchair, pressure sores may develop where any one area of skin or tissues deep to the skin are subjected to high pressure while sitting or lying for long periods of time. This situation may also develop for other users who simply are forced to sit for long periods of time.

There is an ever increasing demand for the prevention of pressure sore formation among chronic wheelchair users worldwide. Wheelchair users are especially susceptible to pressure sores due to the prolonged periods of time seated with inadequate redistribution of pressure. Pressure sores greatly impact the quality of life of a person and can lead to a loss of normal activity, increased susceptibility to infection, and death.

Pressure sores are a worldwide problem. These wounds develop from prolonged pressure on soft tissue, and are most common in those who spend prolonged time in a wheelchair or a bed. When sufficient pressure is applied to the soft tissue, blood flow though capillaries and larger blood vessels is occluded. When capillaries are occluded for extended periods, there is an increase in their permeability which leads to an increase of interstitial tissue fluid, edema, and tissue necrosis.

Pressure sores are classified in four stages. The first stage can be recognized by redness and slight hardening of the skin which is due to a buildup of fluid under the epidermis. A stage two pressure sore involves skin breakage at the epidermis layer. A stage three sore includes wound extension to the subcutaneous tissue. In a stage four sore, the wound deepens down to the bone, and necrotic tissue along with drainage are present.

Pressure sores also lead to multiple secondary diseases. Some of the most common secondary diseases are bacterial infection and sepsis which are caused by loss of skin thickness which removes the natural bacteria barrier. Musculoskeletal complications are also commonly found and include osteomyelitis and pyarthrosis.

Pressure sore prevention and treatment also incur a large economic cost. For example, within the Western Cape region of South Africa in the past, the costs associated with pressure sores total between $6.5-10 million annually (GDP adjusted). In addition, in the United States the cost to treat one sore is $2,000-$30,000, depending on the severity of the wound. Furthermore, it has been estimated that pressure sores cost the US healthcare system $3.3 billion annually. A large portion of this cost is treating a pressure sore. If prevention methods were improved, this cost could be greatly reduced.

Pressure on soft tissues is considered pathologic when it exceeds capillary filling pressure. This filling pressure is approximately 32 mmHg in the arteriole limb, 20 mmHg in the middle limb, and 12 mmHg in the venous limb. Health care professionals typically cite a pressure of 32 mmHg as being the upper limit of acceptable pressure on a person's legs and buttocks for extended periods. Several researchers have investigated the possibility that occlusion of lymph vessels is a stimulus for wound formation. One function of the lymph system is to return excess interstitial fluid to the circulation. If lymph vessels have collapsed due to excess pressure, function is disrupted. However, lymph closing occurs at a higher pressure than does capillary closing pressure (approximately 60 mmHg) so using this value as an upper limit of acceptable pressure is less conservative. It is also important to note that pressure is usually not evenly distributed across a person's legs, buttocks, and lower back. Typically the pressure is concentrated under the bony prominences of the ischial tuberosities, coccyx, and sacrum.

Magnitude of pressure is not the only relevant factor in pressure sore formation; the duration of applied pressure is of equal importance. Multiple studies have investigated the relationship between tissue damage and the magnitude and duration of pressure application. At the ischial tuberosities, the pressure must be below 20 to 30 mmHg in order to prevent pressure sores in people who have scar tissue and atrophy of the gluteal muscle. When pressures exceed 30 to 40 mmHg, pressure sores develop. There is no consensus on the magnitude of harmful pressure and the exact damaging pressure is still controversial. Even for pressures up to 70 mmHg, alternating the regions under pressure every 5 minutes results in no pathologic changes in soft tissue. Similarly, tissues under pressure up to 200 mmHg for one and a half hours showed minimal changes if one hour of pressure relief was allowed after. If low pressure is maintained for a long period of time, this produces a greater damage than high pressure applied for a short period. Therefore, it is important to manage both pressure magnitude and duration.

There has been some work devoted to determining a quantitative relationship between pressure magnitudes and durations which produce pathologic changes in soft tissue. Most of the work in this area consists of theoretical models of soft tissue tolerances to pressure magnitude and duration. Experimentally, a quantitative relationship between tissue tolerances and pressure magnitude and duration has been developed from clinical observations in hospitals. It should be noted that these relationships are not definitive and pressure sores may still form even if these limits are not exceeded.

Another mechanism which may lead to pressure sores is ischemia-reperfusion injury. Ischemia-reperfusion injury occurs around an area of occlusion when cells are initially deprived of nutrients but are then injured when the tissue is suddenly allowed to reperfuse. Therefore it is not only the ischemic necrosis that leads to pressure sores, but also ischemia-reperfusion injury. Therefore, complete and total relief from pressure after a period of occlusion may be damaging to the soft tissue. If the pressure magnitude and duration are to be managed by a device, this mechanism must also be considered.

Other stimuli which contribute to pressure sore formation include shearing forces, friction, and moisture. Shearing forces are thought to damage the soft tissue by deforming and damaging blood vessels as well as subcutaneous fat. Friction has been shown to increase pressure sore formation by disruption of the stratum corneum of the skin. Fewer studies have investigated the exact mechanism of damage due to moisture besides weakening skin integrity, but clinically it has been shown to increase the risk of pressure sores by a factor of five.

There are numerous risk factors for pressure sore development. There are a number of extrinsic risk factors which include decreased movement, immobility, spinal cord injury (SCI), and loss of sensory perception. Intrinsic factors include: age, nutrition, smoking, diabetes, and renal disease.

Wheelchair users are especially susceptible to pressure sores due to the prolonged periods of time seated without redistribution of pressure. In a population of wheelchair bound patients with a spinal cord injury, there was an 85% incidence of pressure sore formation. Pressure sores greatly compromise the health of a person, greatly increases the chance of infection, and is a direct cause of death in 8% of paraplegics.

There are currently various methods employed in the prevention of pressure sores for people in wheelchairs. These methods mainly focus on altering the design of the wheelchair cushion in an attempt to redistribute the user's weight over a wider area of the cushion; hence removing concentrated areas of high pressure which may cause pressure sores. Such traditional solutions tend to focus on even distribution of pressure on the surface that the patient is either sitting or lying on.

For example, a specialized pad may be placed on a wheelchair so that pressure of the human body is evenly distributed. Other traditional solutions include sensors that prompt the patient to change position to prevent the formation of pressure sores. Still other traditional solutions require the intervention of medical professionals to prevent the patient from developing pressure sores. For instance, foam cushions are the most commonly utilized form of pressure sore prevention and aid in the distribution of pressure over a wider area than a standard wheelchair seat. Usually this foam is cut or formed into a contoured shape in order to aid in pressure redistribution. Most foam cushions have the benefit of being light-weight; hence the use of one does little to impact the effort of ambulation. There are various contoured foam cushion designs already available on the market, each with their own design for pressure redistribution.

Depending on the material and extent of customization, this method of pressure sore prevention can be fairly inexpensive when compared to more technologically advanced alternatives. However, despite their widespread use, cushions alone do not effectively reduce the incidence of pressure sores.

Gel filled cushions typically use an inner layer of gel contained within a foam border and are covered with a polymer barrier. Pockets filled with gel are allowed to flow and mold to the shape of the person seated. However, gel wheelchair cushions have often been known to produce excessive pressure against the skin of the person seated, especially around the more bony regions of the buttocks. This raised pressure also contributes to heat and moisture buildup.

Wheelchair tilting systems have also been contemplated. These systems function by tilting the wheelchair seat at an angle. By tilting the seat, the support pressure is decreased on the buttocks and legs and increased on the back. This variation in support pressure helps to ensure that vessels are not completely occluded over long periods of time. Tilting wheelchairs are generally intended for people who are at a higher risk of pressure sores that spend large portions of the day seated as well as those who struggle with being seated upright for extended periods of time Given the foregoing limitations of traditional solutions to the problem of pressure sores, a need exists for enhanced solutions to support patients, e.g., in wheelchairs or beds.

SUMMARY

In one aspect, a seat, such as a wheelchair is provided. The seat or wheelchair includes supports for supporting a user. The supports are configured to reduce or prevent ischemia or pressure sores of the user. For instance, the use of supports, rather than a pressure distributing pad, reduces pressure sores.

In another aspect, a system of supports for supporting a user is presented. A group of the supports is arranged along the perimeter of the shape. At least some of the group of the supports have different vertical positions.

In another aspect, a wheelchair is provided. The wheelchair includes supports for supporting a user. The supports are arranged as a repeating pattern of shapes, the individual supports being peripherally disposed along perimeters of the shapes. The repeating pattern of shapes includes a first shape overlapping with a second shape, and some of the individual supports are disposed along perimeters of both the first and second shapes.

The above embodiments are exemplary only. Other embodiments are within the scope of the disclosed subject matter.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the disclosed subject matter encompasses other embodiments as well. The drawings are not necessarily to scale, emphasis generally being placed upon illustrating the features of certain embodiments of the invention. In the drawings, like numerals are used to indicate like parts throughout the various views.

DETAILED DESCRIPTION

Figure 1:
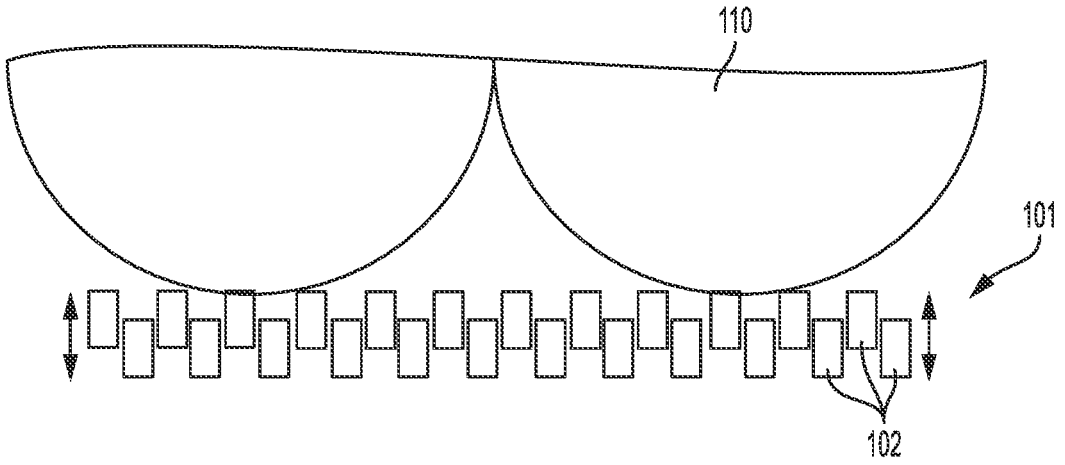
FIGS. 1-3 depict a support system with alternating pillars in different positions.

Embodiments of the disclosed subject matter provide techniques for reducing pressure sores in a patient who is confined to a wheelchair or bed, and include wheelchairs and systems of supports for wheelchairs, beds, etc. Other embodiments are within the scope of the disclosed subject matter.

The present disclosure relates to, in one aspect, a dynamic system of supports to be used with or as part of a wheelchair, bed, seat, or other structure, which promotes circulation and prevents or minimizes ischemia and prevents or minimizes pressure sores. The system may include an array of supports, pillars, elements, etc., that reposition in such a way as to promote circulation, prevent ischemia, and prevent pressure sores in an individual. Advantageously, the present disclosure includes a dynamic system in which a pattern of supports are defined, with different subsets of the supports, and the different subsets are used to alternately change position to support the user, while other supports either remain stationary or also change position so as not to support the user. As another advantage, by changing the position of where a user is supported, pressure sores and other related medical problems can be mitigated or alleviated. As another advantage, by defining the different subsets of the supports along a perimeter of a shape with an interruption in the perimeter (e.g., the supports are unevenly distributed along the perimeter to leave a gap), and/or to define the shapes to overlap, pressure on the user is dynamically changed so as to mitigate or alleviate pressure sores. Applicants have discovered that these dynamically changing supports can be used in wheelchairs or other seats or beds, and by choosing appropriate patterns and/or spacing of patterns as defined herein, pressure sores may be mitigated. By contrast, traditional solutions are focused on pressure redistribution, and are not focused on eliminating the conditions that cause pressure sores, and fail to provide favorable user and patient outcomes.

Generally stated, described herein is a wheelchair. The wheelchair includes supports for supporting a user. The supports are configured to reduce or prevent ischemia or pressure sores of the user. In one embodiment, a group of the supports is arranged along a perimeter of a shape and at least some of the group of the supports have different vertical positions. In another embodiment, the supports are arranged as a repeating pattern of shapes, the individual supports being peripherally disposed along perimeters of the shapes. In a further embodiment, the pattern of shapes includes a first shape overlapping with a second shape, and some of the individual supports are disposed along perimeters of both the first and second shapes.

In one example, at least some of the supports change vertical positions relative to the user. In another example, the supports have at least two vertical positions relative to the user. In a further example, the supports have at least two horizontal positions relative to the user. In yet another example, the supports are or include pillars supported by springs.

In one specific implementation, the wheelchair includes an actuator configured to change positions of the supports, and the actuator may be electrical, mechanical, electromechanical, magnetic, pneumatic, hydraulic, etc. In another example, the supports may include at least first supports and second supports. The first supports may have a first height and the second supports having a second height. In a further example, the supports may include an array of beads or other shaped supports that can roll. The beads may be configured to translate horizontally relative to the user.

In one embodiment, the supports may include first supports having a first width and second supports having a second width. In another embodiment, the supports may include at least first supports and second supports. The first supports may have a first vertical position when the second supports have a second vertical position. The first supports may have the second vertical position when the second supports have the first vertical position. In a further embodiment, the supports may include first supports and second supports. The first supports may be arranged within a perimeter defined by the second supports. In yet another aspect, the supports may include first supports and second supports. In such a case, each of the first supports may have a first size, and each of the second supports may have a different second size. Optionally, a total of three, four, five, or any number of additional sets of supports may be defined to move together as well, even including each of hundreds of supports moving independently to change positions in a specific pattern.

In another aspect, presented herein is a system of supports, which may be used with any patient or user supporting structure, such as a chair, bed, wheelchair, vehicle seat, medical table, etc. A group of the supports may be arranged along the perimeter of the shape. At least some of the group of the supports may have different vertical positions. The position and size of the different supports may be selected to minimize pressure sores as disclosed herein.

In another aspect, a wheelchair is provided. The wheelchair includes supports for supporting a user. The supports are arranged as a repeating pattern of shapes, the individual supports being peripherally disposed along perimeters of the shapes. The repeating pattern of shapes includes a first shape overlapping with a second shape, and some of the individual supports are disposed along perimeters of both the first and second shapes.

In one implementation, the distribution of supports changes temporally. For instance, the temporal change may occur once every 30 seconds to 30 minutes, and more specifically may occur every 2 minutes to 20 minutes. In such a manner, this temporal adjustment may reduce and/or eliminate pressure sores of the user.

In another example, the supports may contact the individual patient through their clothing or through a fabric layer that may be disposed over the support. The supports may each have two or more vertical and/or horizontal positions, and the change of positions temporally facilitates the reduction of pressure sores. Because shearing of the skin may be an issue, supports may be configured to only move vertically or approximately perpendicular to the surface of the seat to avoid/eliminate shearing.

In one implementation, spacing of the supports is such that there are regions between supports where the pressure drops to below capillary perfusion pressure or approximately 32 mm Hg. In another example, the spacing of the supports is such that when the distribution of supports changes temporally, regions with pressure above capillary perfusion pressure or approximately 32 mm Hg become regions with pressure below capillary perfusion pressure or approximately 32 mm Hg.

In a further example, the array of supports creates regions where individual supports are small enough and close enough together that they cluster to support the weight of the body where they make contact (e.g., through a cloth pad) with the skin, and pressure in those regions can be greater than capillary perfusion pressure or approximately 32 mm Hg. At the same time, the array of supports creates regions where the clusters of individual supports are far enough apart that the pressure between the clusters (where no support makes contact with the skin directly or indirectly) is below capillary perfusion pressure or approximately 32 mm Hg. When the distribution of supports changes temporally, the location of the clusters of support are modulated so that regions which were supported with clusters are now unsupported and regions which were unsupported are now supported with clusters.

In one specific example, the distribution of supports creates at least two regions: A region of supports clustered to support the body by contacting the skin (directly or indirectly through a cloth pad) and a region between clusters of support where the body is not supported by contact of the skin (directly or indirectly through a cloth pad).

The individual supports may be cylindrical in shape, but also could be square cross-section, rectangular cross-section, oval cross-section, or other area.

Individual supports within the array may be 1 mm to 25 mm in diameter (+/−1.0 to 625 $mm^2$ contact area) or in an exemplary embodiment may be 4 mm to 12 mm diameter (+/−12.5 to 115 $mm^2$ contact area). The supports may be arranged such that individual supports in a cluster are 1 mm to 15 mm apart (have a 1 mm to 15 mm gap between) and in an exemplary embodiment, the individual supports in a cluster are 2 mm to 10 mm apart. The supports are further arranged such that there are unsupported regions between the clusters of supports, the unsupported regions are 7 $mm^2$ to 320 $mm^2$ in area. In an exemplary embodiment, the unsupported regions are 100 $mm^2$ to 175 $mm^2$. In another example, the size and shape of the support region results in pressure inside the perimeter of the region to be below capillary perfusion pressure or approximately 32 mmHg.

In one example, the supports are arranged in the form of interrupted support regions, which means that the clusters of supports look like interrupted shapes. In other words, rather than the supports forming a complete perimeter of a shapes like circles, squares, rectangles, ovals, etc., the shapes are not completely closed, or have a larger than usual gap.

In another example, the interrupted support regions contact the user (directly or indirectly through a cloth pad) along the perimeter of the support region and leave the middle region (inside the perimeter) unsupported. Alternately, the middle region may be supported by one or more other supports arranged in a different shape.

The supports can be manually actuated with a lever, crank, dial, knob or by an automated mechanism. The lever, crank, dial, knob or automated mechanism turns a cam, belt, gear, screw or similar mechanical system to provide vertical actuation of a fraction of the support array, for example half of the support array if there are two equally numerous sets of supports. Alternatively, actuation can be achieved by a pneumatic, hydraulic, magnetic, solenoid, motor, or other mechanical or electrical system.

In one example, each time the supports are actuated, the state of the support array changes and the supports which were contacting (directly or indirectly) the user become non-supporting and the supports which were non-supporting become supporting. This is achieved through a change in the axial position of the two (or more) subsets of array supports.

Alternatively, the clusters of supports or individual supports can be collapsible and have their state engaged or disengaged temporally. The supports in the firm state contact the user (directly or indirectly) and support them. The supports in the compliant state do not support the user. Each time the state of the supports are changed, the firm supports which were contacting (directly or indirectly) the user become compliant and non-supporting and the supports which were compliant and non-supporting become firm and supporting. This is achieved through a change in the firmness of the two (or more) subsets of array supports. A change in firmness can be achieved by changing the pressure within clusters of collapsible supports or individual supports by adding or removing air or other fluid to the supports or by changing the temperature or applying a current to a shape memory material or applying a magnetic field to a magnetorheological material. The array of supports need not necessarily be flat (planar). The contour of the supports can be made to match the contour of the user or to match the surface onto which or into which the support array is attached. In one embodiment, the user sits on a planar array of supports, each of which is in series with a spring or similar elastic element. The weight of the user's body compresses the spring under each support a different amount based on the contour of the body. For example, a user may sit on a planar array of supports which results in a support array of variable height (vertical position) of individual supports to accommodate the shape of the user's legs, buttocks, etc. Once the supports are contoured, the contoured array is then used as the interface between the seat (or bed) and user. The support array is actuated vertically so that a fraction, for example half, of the array supports the body at any given time and alternates temporally with the other approximately half of the array. In another example, the fraction may be different based on the number of sets of supports that operate in tandem. For instance, there may be N different groups of supports that operate out of phase with one another, such that the user is supported by N-X of the groups at any given moment, with X groups in a lower vertical position. X could be any number from 1 to N−1.

In one example, the individual supports are monolithic (single component) and can be made from solid semi-rigid materials or solid rigid materials, or collapsible materials (air bladder) or shape memory materials or magnetorheological materials. In another example, the support clusters are fabricated from larger multi-support arrays which are molded or formed from solid or collapsible materials. For instance, the total number of supports in contact with the user may be hundreds to thousands.

As one of the many examples of the present disclosure, the supports disclosed herein act as an interface between a person and the surface on which they are sitting or lying. For long term wheelchair users or bed ridden individuals, the array of supports prevents prolonged times where any one area of skin or tissues deep to the skin are subjected to high pressure while sitting or lying for long periods of time.

Further details of the wheelchair and system of supports of the present disclosure are set forth below in further detail with respect to the drawings. As will be readily understood by a person having ordinary skill in the art, the drawings and discussion below are examples meant to illustrate the claimed invention, and are not meant to limit the invention in any way.

When reviewing the further details below in light of the drawings, it is to be understood that the features depicted in one drawing may be combined with features depicted in another drawing to assemble a wheelchair or system of supports for a user or patient. For example, where a section of a support is shown in isolation, that section may be installed into a wheelchair, bed, or other structure. And although only some depicted embodiments show structural details of actuators, levers, springs, moving platforms, and the like, such a presentation is only for ease of illustration. A person having ordinary skill in the art will understand that the disclosure herein specifically includes using the different features in combination with one another. Specifically, the patterns and mechanisms of supports may be installed in a square or rectangular pattern, or could be arranged on any other shape, such as an irregular curved shape of a wheelchair seat or vehicle seat, or repeated so as to fill the area of a bed. In addition, where one figure shows a lever and/or actuator system for changing vertical and/or horizontal position of the supports, such a lever and/or actuator system is designed for use with other embodiments disclosed in other figures.

Figure 2:
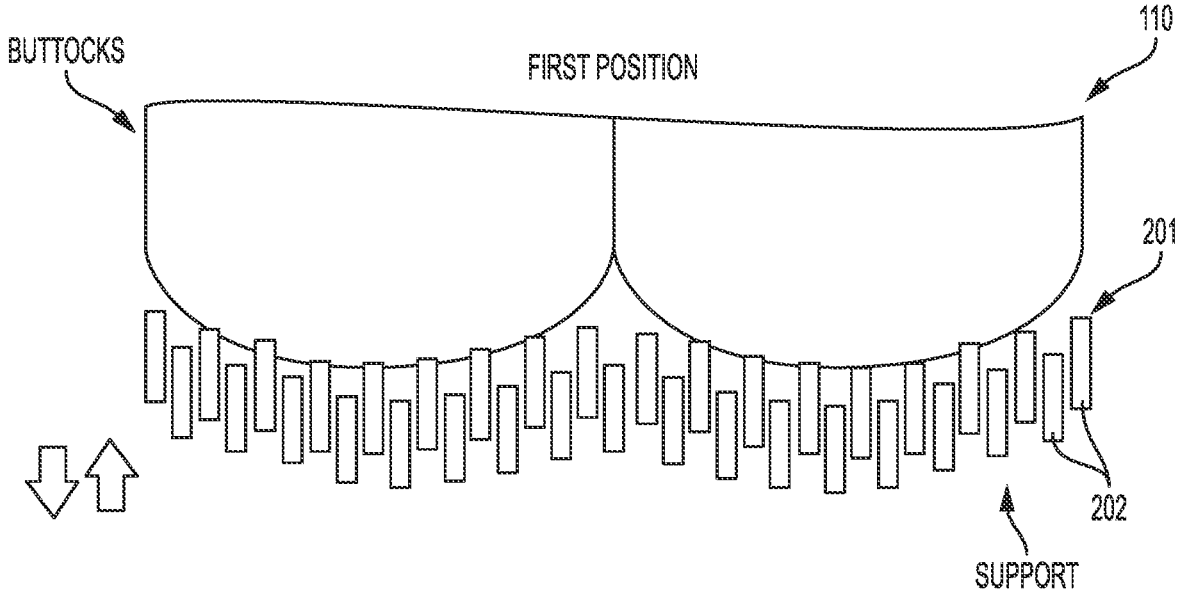
Figure 3:
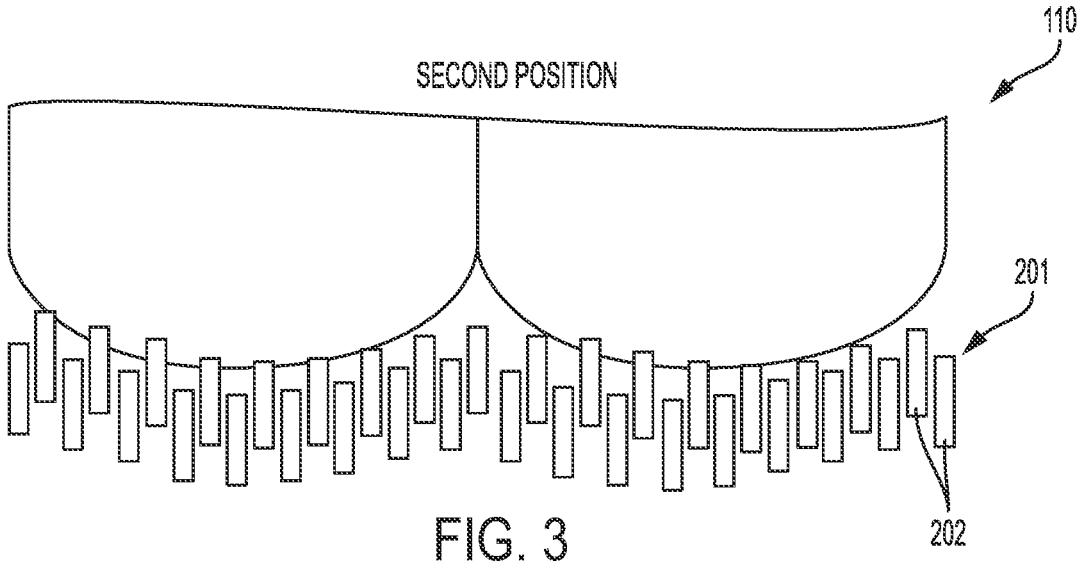

Turning next to the specific implementation examples of the present disclosure, FIG. 1 depicts a generalized support system 101 with alternating supports or pillars 102. The buttocks or legs 110 of a user or patient are depicted. FIGS. 2-3 depicts a support system 401 with alternating pillars 102 in a first position and a second position. In the embodiments of FIGS. 1-3, the individual supports or pillars 102 may move up and down in a vertical manner. For example FIG. 2 and FIG. 3 differ in that alternate supports 202 are moved from an up position to a down position and vice versa.

Figure 4:
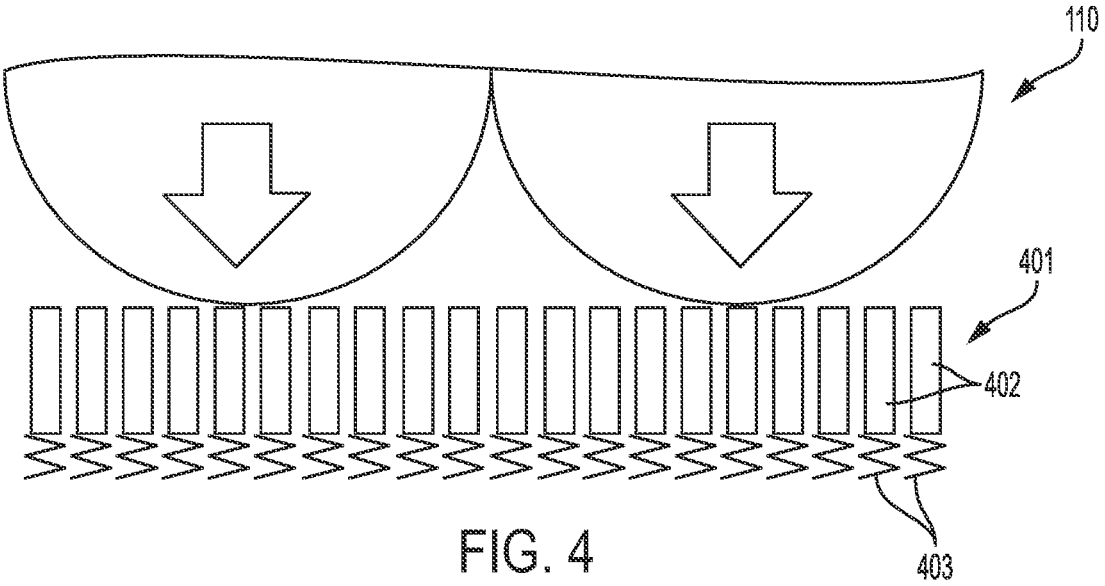
FIGS. 4-7 depicts support systems with alternating pillars and springs in different positions.
Figure 5:
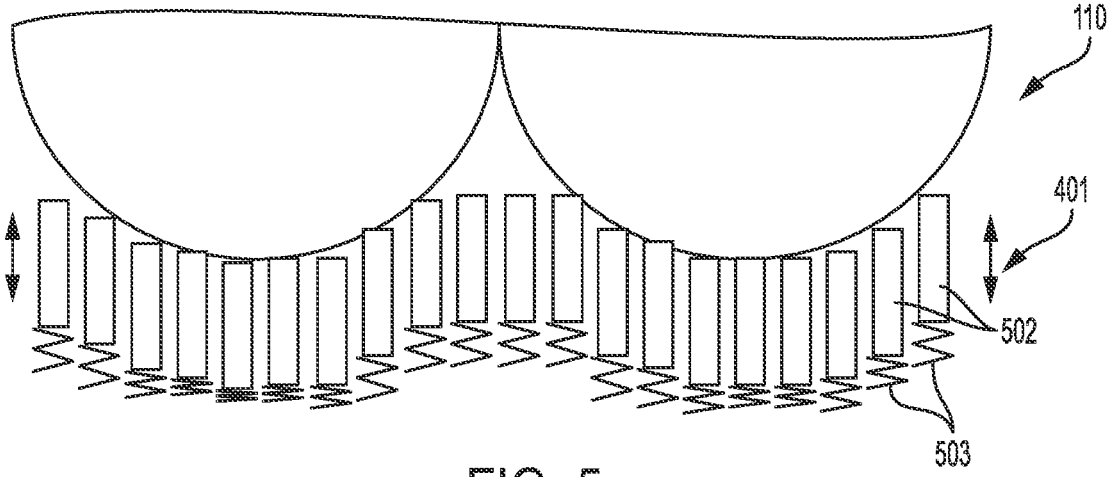
Figure 6:
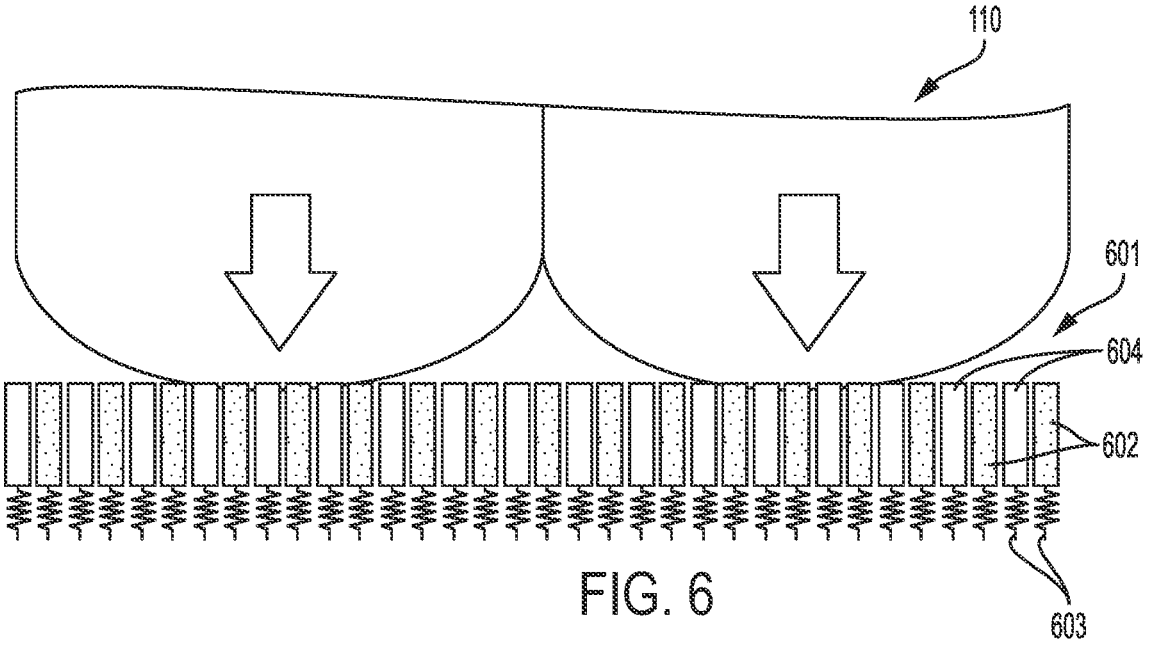
Figure 7:
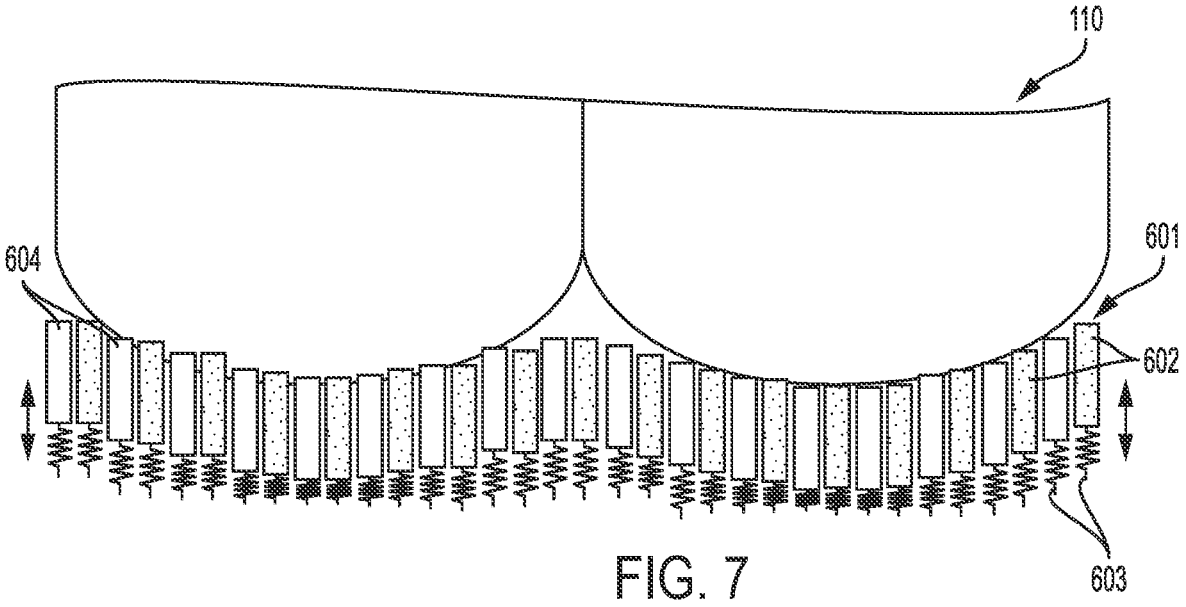

FIGS. 4-7 depicts support systems with springs 403, 503, 603 in different positions. Specifically, FIG. 4 depicts a support system 401 having supports 402 with springs 403 in a first position. In FIG. 5, the support system 401 has moved in such a way that more of the supports 502 are in contact with the buttocks of the user. FIGS. 6-7 depict another support system 601 in which supports 602, 604 have moved from a uniform vertical position in FIG. 6 to a position in which more of the supports are in contact with the user in FIG. 7.

Figure 8:
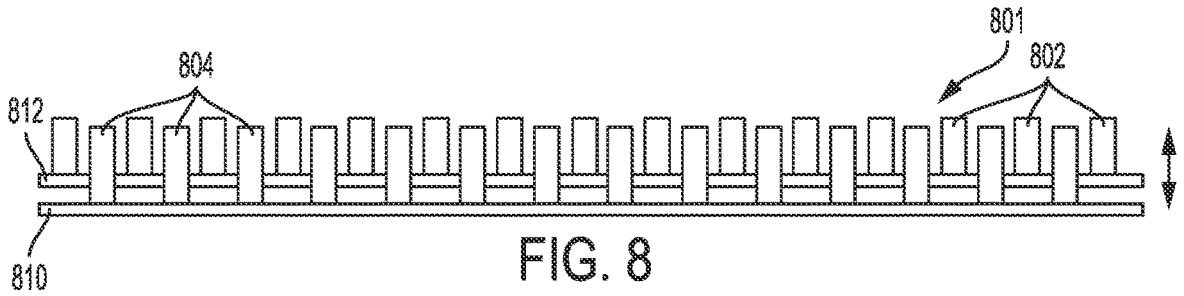
FIGS. 8-10 depicts a support system with alternating pillars in different positions, actuated by a mechanical lever knob or similar actuator mechanism.
Figure 9:
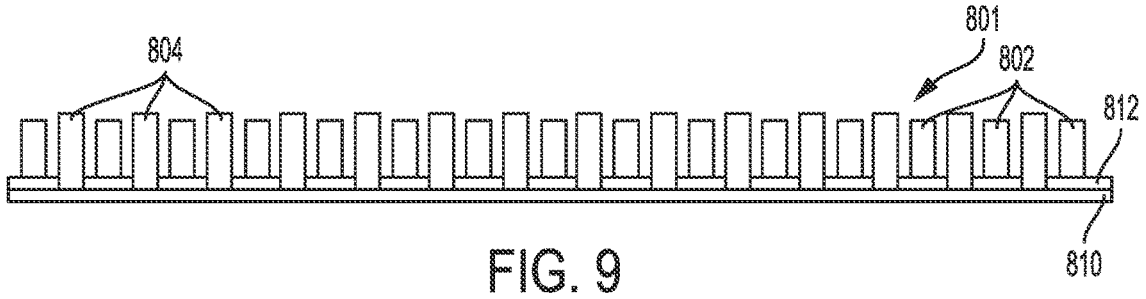
Figure 10:
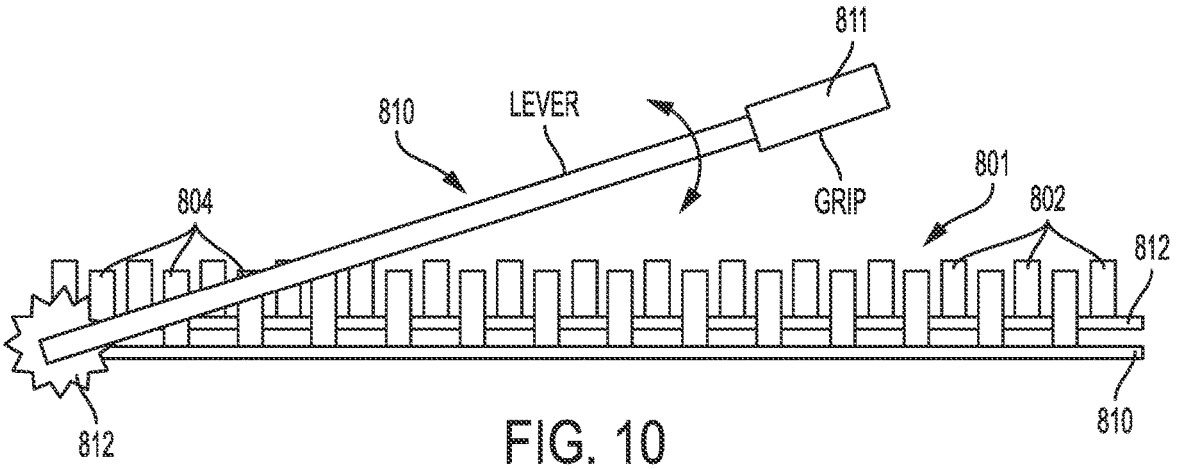

FIGS. 8-10 depicts a support system 801 with alternating pillar supports 802, 804 in different positions, actuated by a mechanical lever 810 (having a grip 811 and pivot 812) or similar actuator mechanism. As may be seen, first supports 802 are attached to an upper plate 822 and second supports 804 are attached to a lower plate 824. When the lever 810 is operated, the first supports 802 and second supports 804 move relative to one another. Indeed, the movement is such that in a first position of FIG. 8, the first supports 802 which includes the first, third, and so on of the supports (counted from the left) are higher vertically and so support the user. And in FIG. 8, the second group of supports 804 which includes the second, fourth, and so on of the supports (counted from the left) are higher vertically and so support the user. As such, the lever 810 changes which of the supports are in contact with the user to support the user. By activating the lever 810, the pressure points on the user are changed and pressure sores may be reduced due to repeated such action going back and forth between the two positions depicted in FIGS. 8-9.

Figure 11:
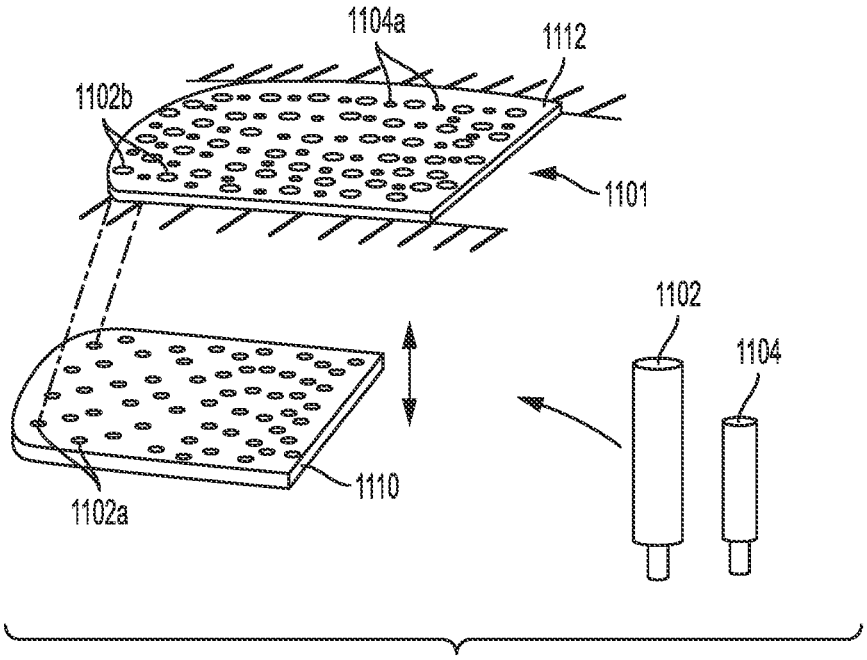
FIGS. 11-12 depicts a support system with supports having varying length pillars which are actuated by a vertical lifting system.
Figure 12:
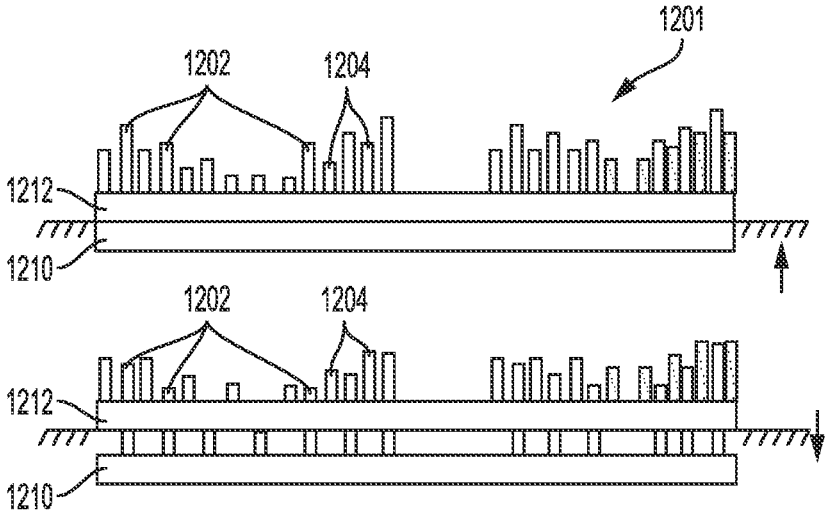

FIGS. 11-12 depicts a support system 1101 with supports having varying length pillars which are actuated by a vertical lifting system, such as first supports 1102 which are taller than second supports 1104. In this example, the pillars have different heights, so that they may better conform with the buttocks of a user. Such a configuration is evidenced in the cross-sectional elevational view provided in FIG. 12. As seen in FIG. 12, the upper view shows the support system in a first position, and the lower view shows the support system in a second position in which an upper plate 1112 moves upward relative to a lower plate 1110. First supports 1102 are attached at points 1102*a* of lower plate 1110, and go through holes 1102*b* of upper plate 1112, and second supports 1104 are attached at points 1104*a* of upper plate 1112.

Figure 13:
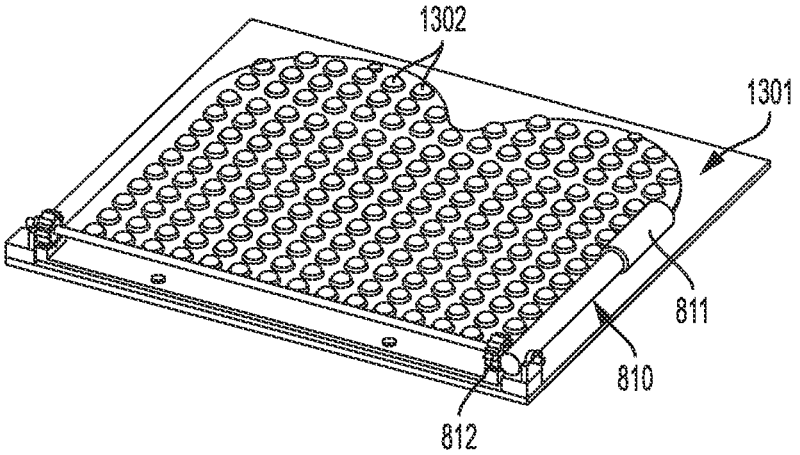
FIGS. 13-16 depicts various support systems including a wheelchair with a support system installed.
Figure 14:
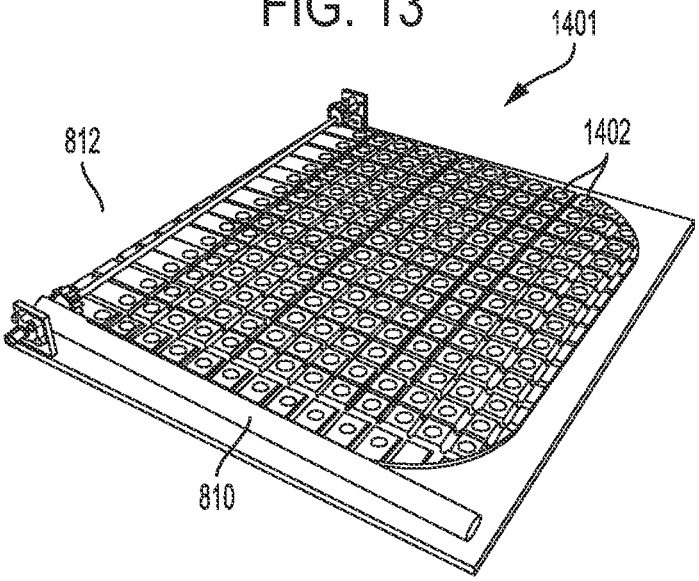
Figure 15:
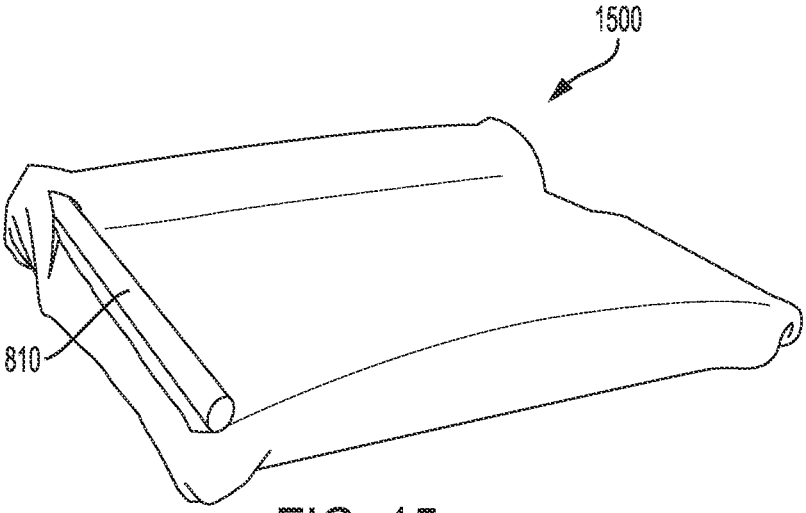
Figure 16:
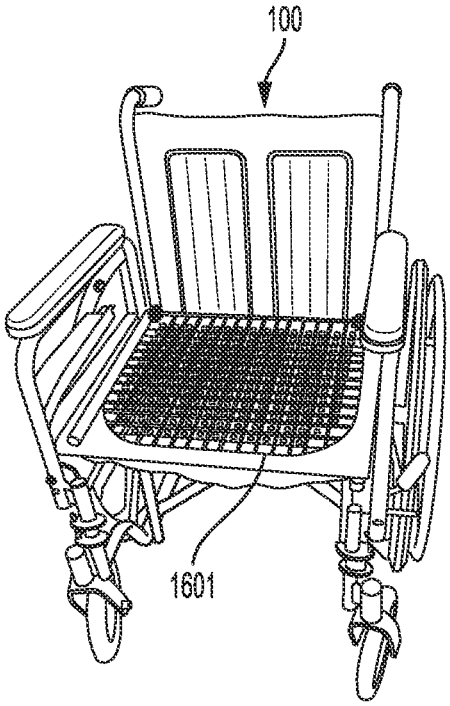

As noted above, the various support systems described herein may be configured for use in different environments, in different shapes, and as part of wheelchairs, beds, etc. FIGS. 13-16 depict several such examples. FIG. 13 shows a support system 1301 in which the supports 1302 form the likely outline of the users seated position. FIG. 14 depicts a support system 1401 in which a mechanical lever 810 is included as depicted in FIG. 10. FIG. 15 depicts a cover 1500 that may be placed on the support system, so that indirect contact of the support system may be made through the cover with the user. FIG. 16 depicts the support system 1401 of FIG. 14 having been installed in a wheelchair 100.

Figure 17:
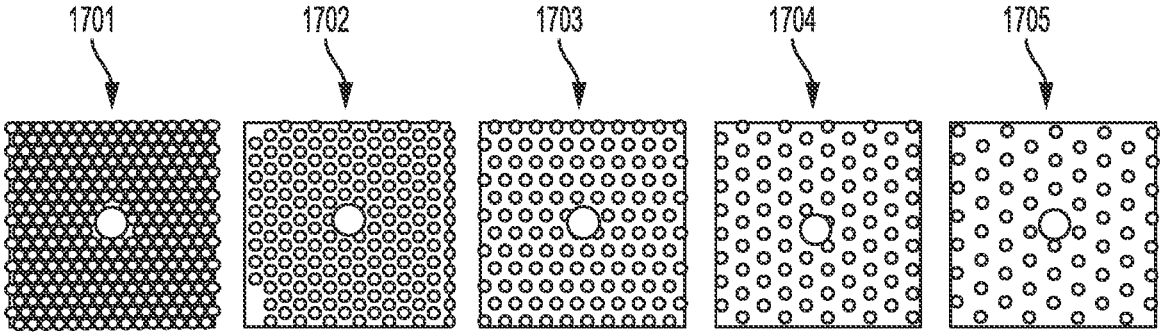
FIG. 17 depicts a support system having various configurations of support arrays.

FIG. 17 depicts a support system having various configurations of support arrays having different spacing. For example, array 1701 has a first spacing, array 1702 has a second spacing, array 103 has a third spacing, array 1704 has a fourth spacing, array 1705 has a fifth spacing, with each spacing progressively increasing. The spacing of the support systems of FIG. 17 could be combined with the alternating support groupings described herein, to form a complete system that mixes and matches the appropriate spacing, number of supports, actuation mechanism, etc.

Figure 18:
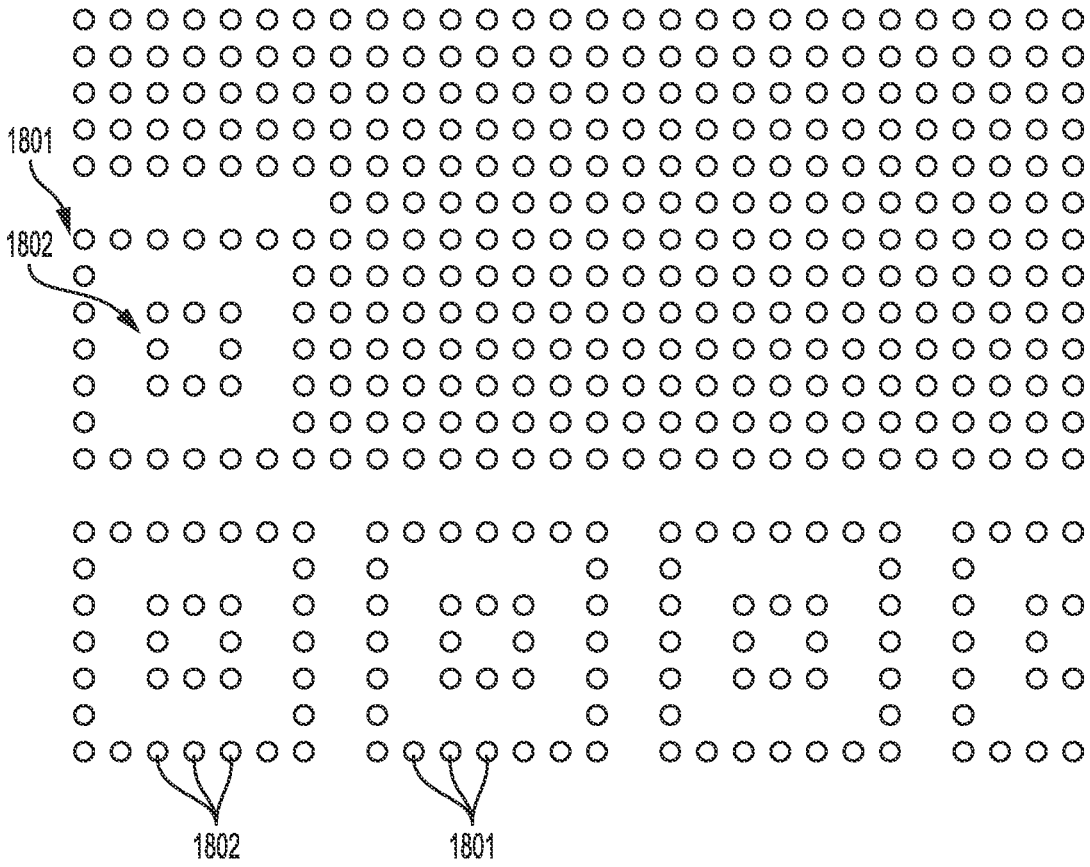
FIG. 18 depicts a support system having an array of supports in two different positions.

FIG. 18 depicts a support system having an array of supports in two different positions. As such, it may be seen that first supports 1801 are arranged peripherally about a first square and second supports 1802 are arranged peripherally about a second square. The first square surrounds the second square. In the manner described above, actuation may be employed so that the supports of each square alternately are raised or lowered to support the user. Thus, the support of the user in the region of the first supports 1801 can alternate with second supports 1802, thus mitigating pressure sores.

Figure 19:
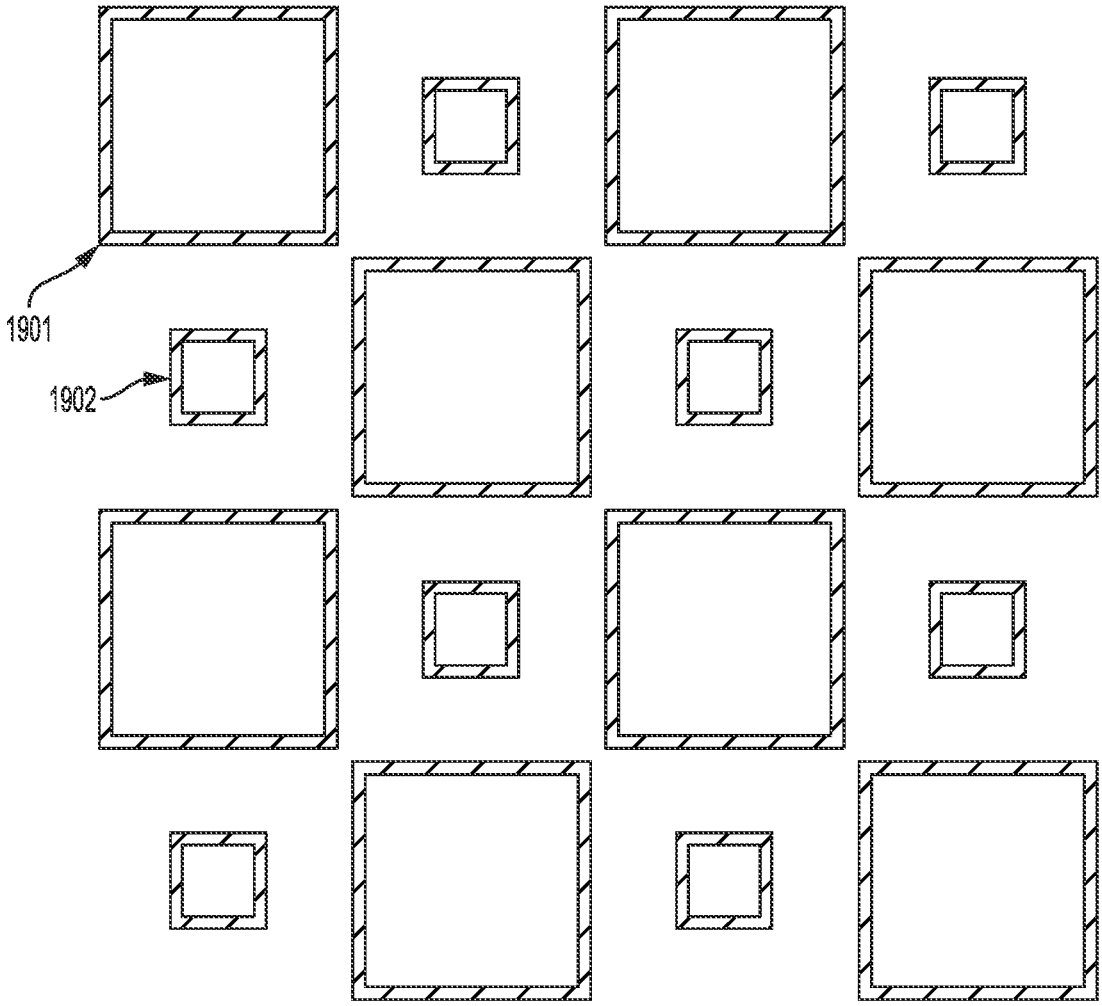
FIGS. 19-20 depict a support system having variable size supports in two different positions.
Figure 20:
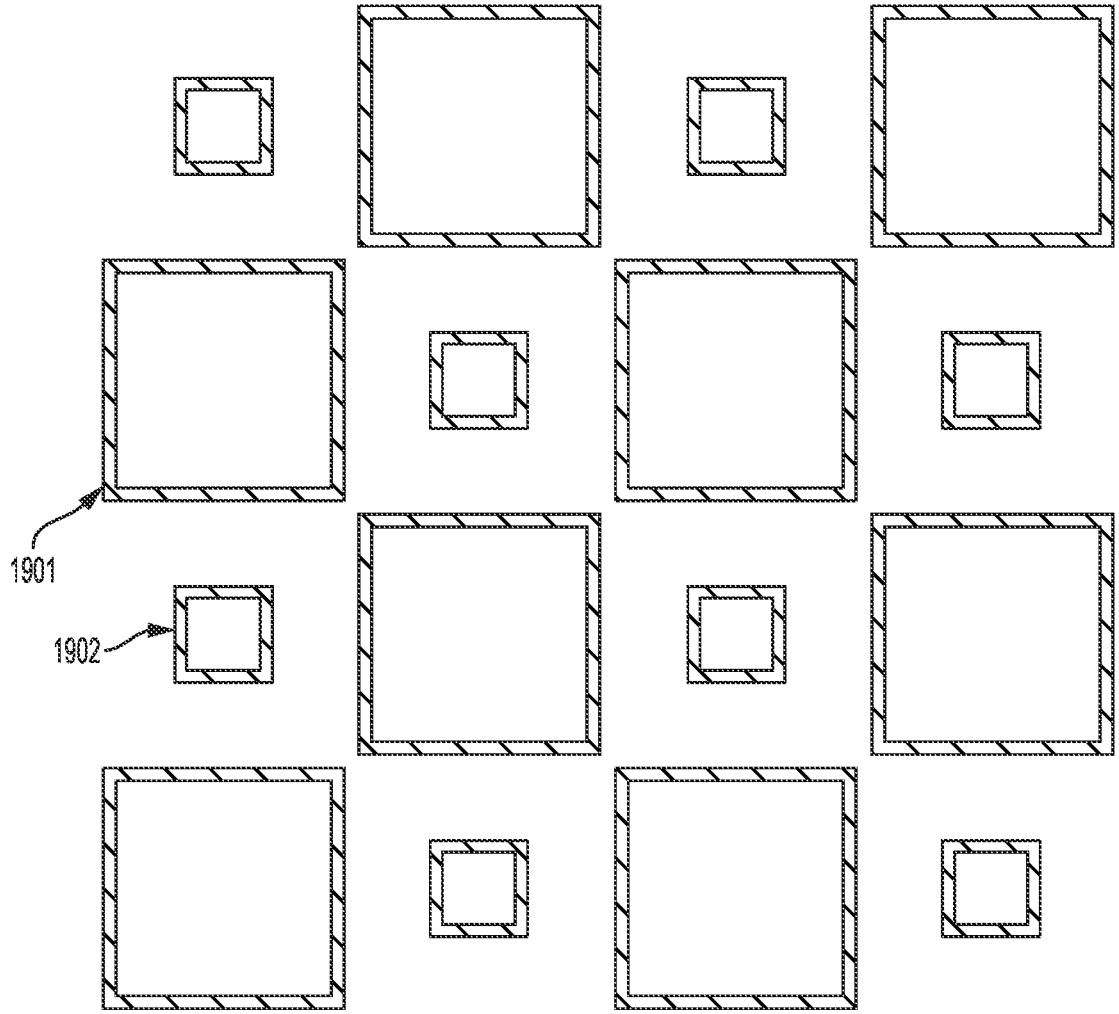

FIGS. 19-20 depict a support system having variable size supports 1901, 1902 in two different positions. In this example, the smaller supports 1902 can alternate with the larger supports 1901, as seen by comparing the alternation in position between FIG. 19 and FIG. 20. In such a manner, again, the region of the user or patient being contacted by the supports will change, to mitigate pressure sores.

Figure 21:
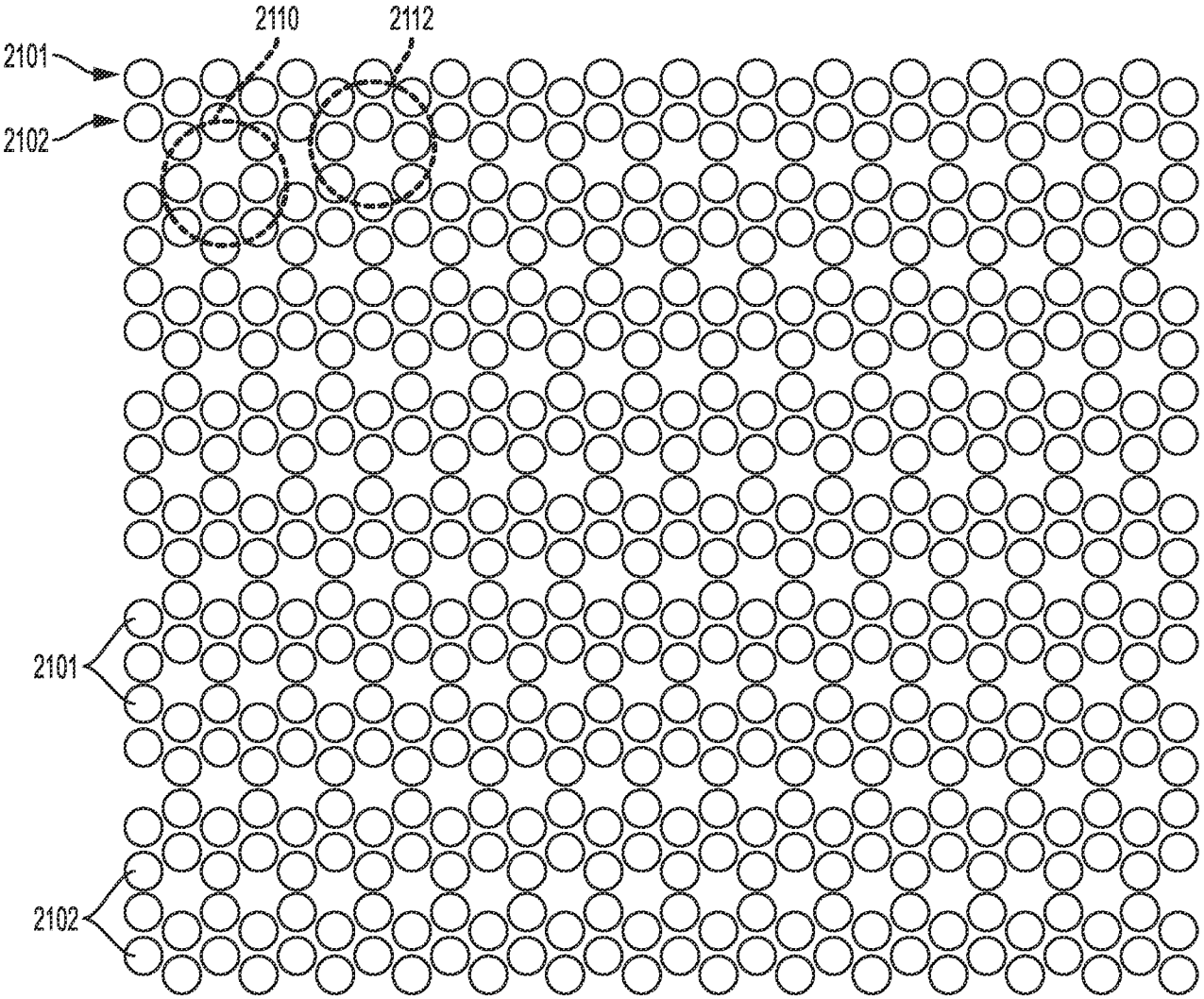
FIG. 21-23 depicts a support system in which first supports are arranged along the periphery of a circle and second supports are arranged along another shape within the circle, with the pattern repeating.
Figure 22:
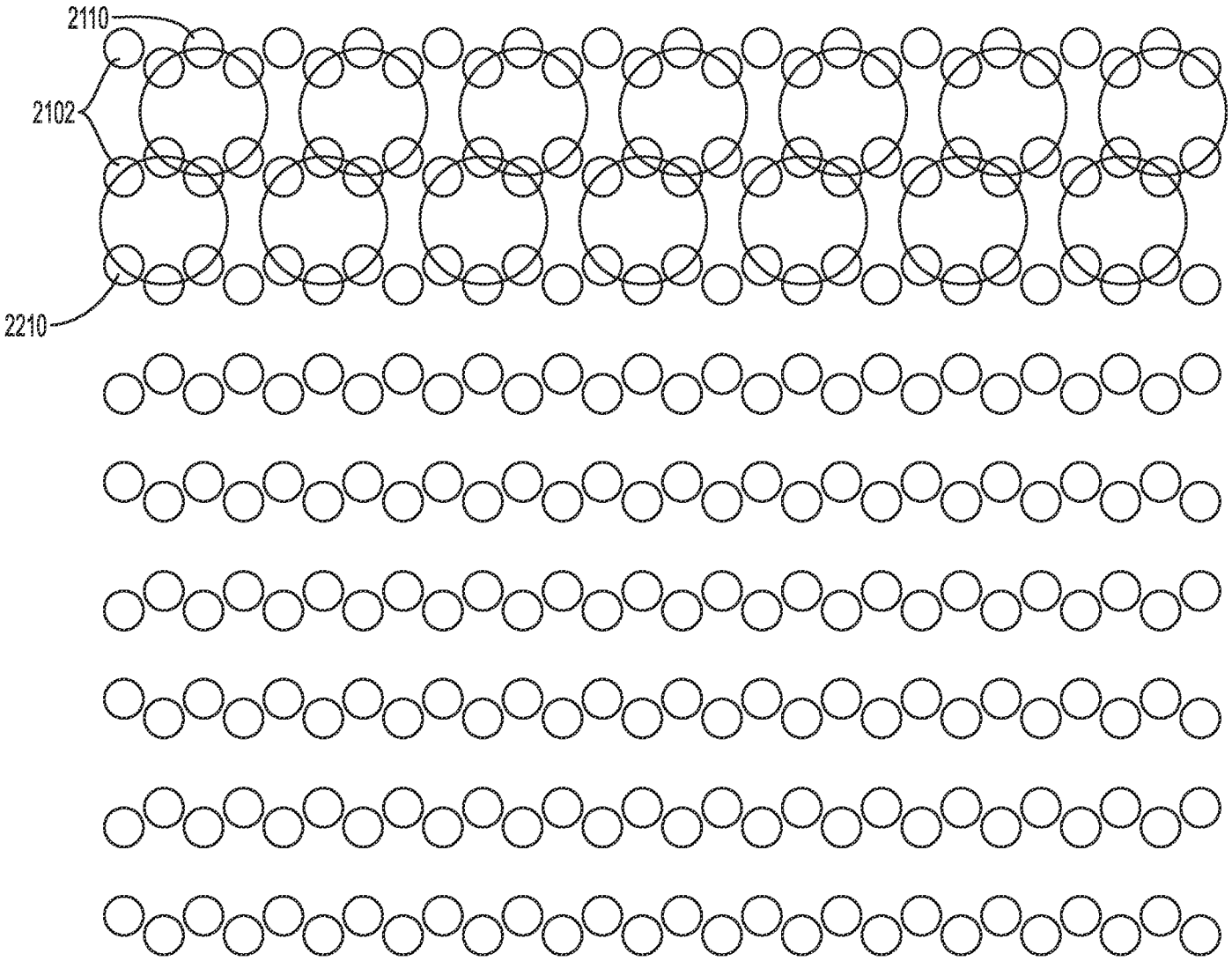
Figure 23:
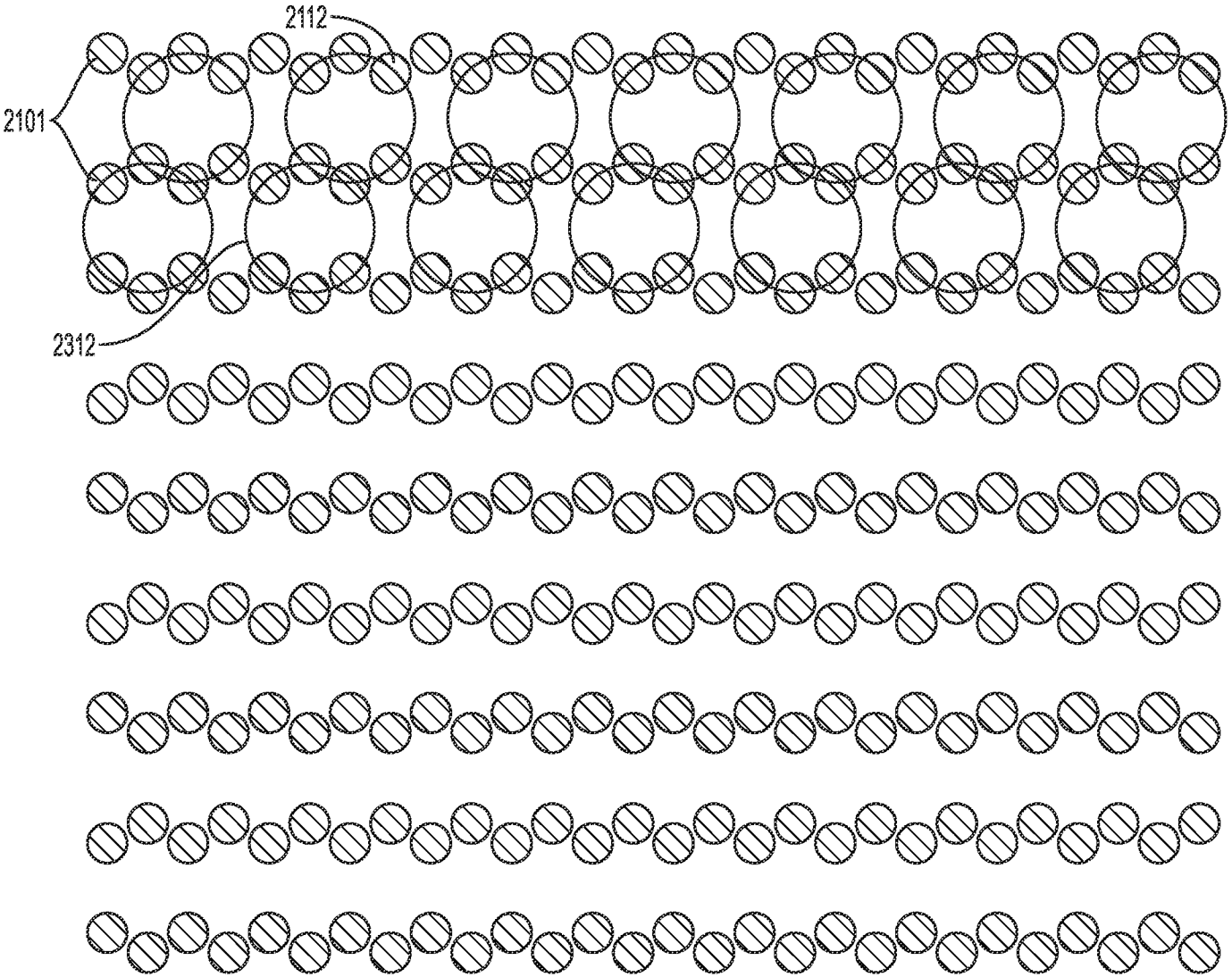

FIG. 21-23 depicts a support system in which first supports 2101 are arranged along the periphery of circles 2112 that surround some second supports 2102, and second supports 2102 are arranged along peripheries of other circles 2110 that surround first supports 2101, with the pattern repeating. As can be seen in FIG. 23, when the first supports 2101, which are shaded, are in the upper position, these supports are supporting the user, and as seen in FIG. 22 when the second supports 2702, which are unshaded, are in the upper position, these other circles are supporting the user.

Figure 24:
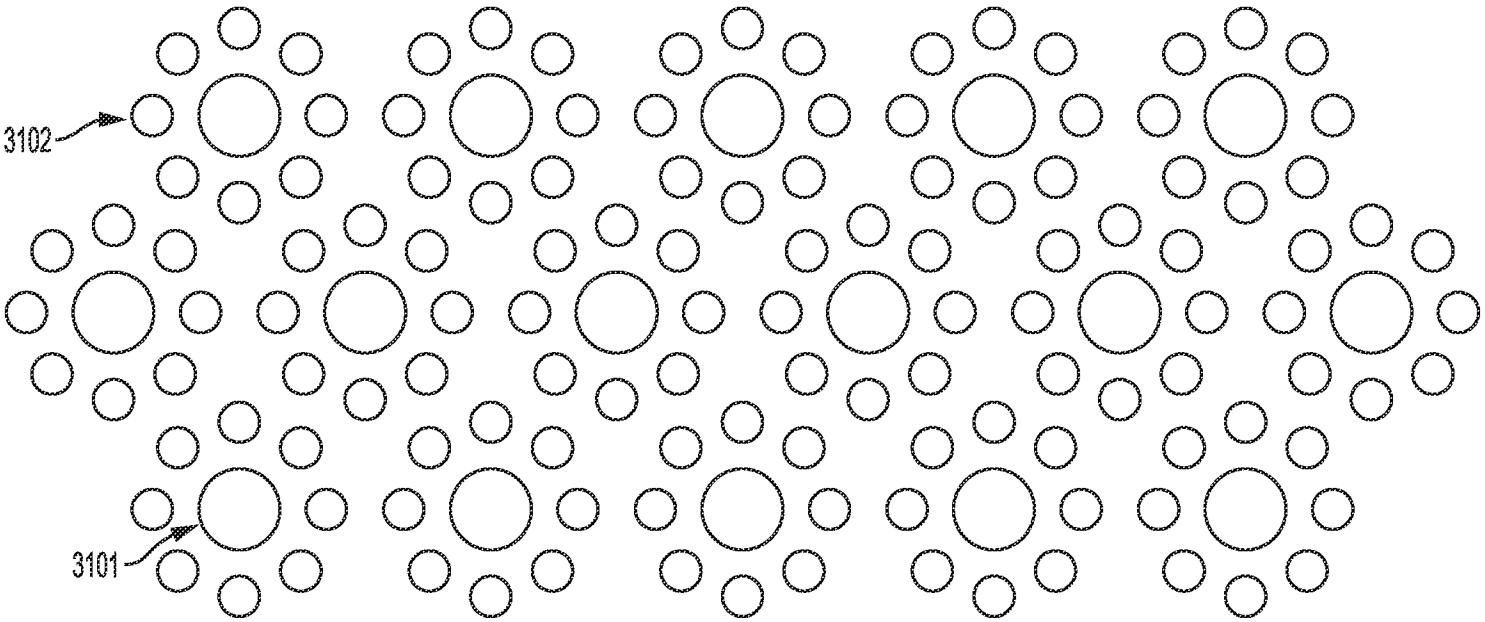
FIG. 24 depicts a support system with first supports surrounded by second supports arranged along the periphery of a circle, in different positions.

FIG. 24 depicts a support system with larger first supports 2401 surrounded by smaller second supports 2402 arranged along the periphery of a circle, in different positions. As may be understood, the support system can allow the user to be alternately supported by the first supports 2401 and the second supports 2402.

Figure 25:
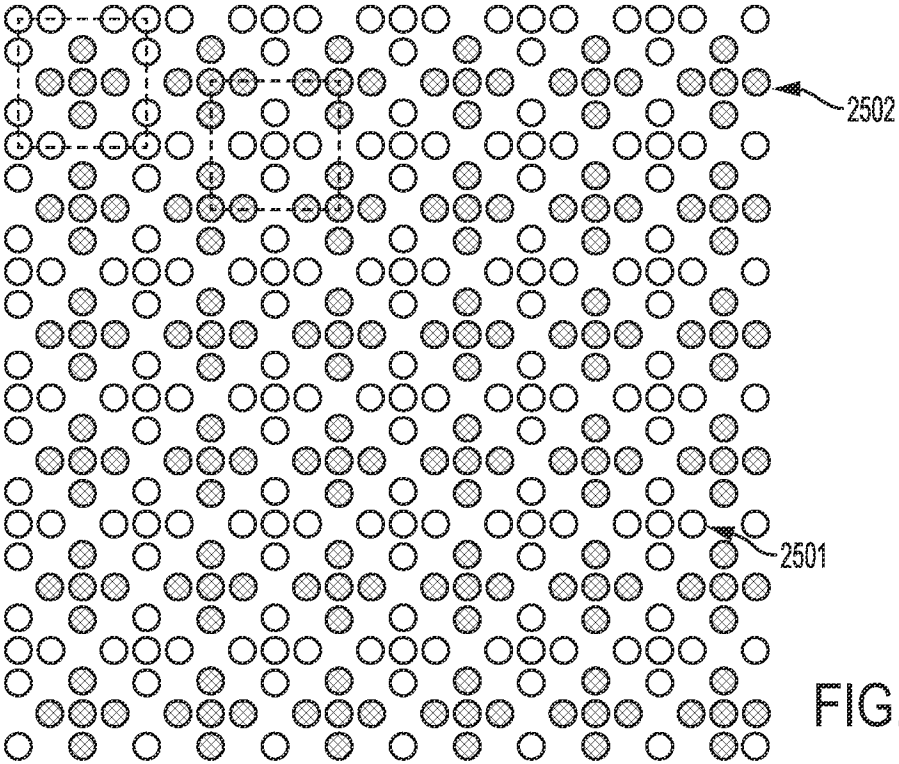
FIG. 25 depicts a support system with first supports in a first position and second supports in a second position.

FIG. 25 depicts a support system with first supports 2501 in a first down position and second supports 2502 in a second up position indicated by shading. As may be seen, the supports are interleaved cross patterns, and as used in a support system for a wheelchair, the first supports 2501 and second supports 2502 will alternate vertical position.

Figure 26:
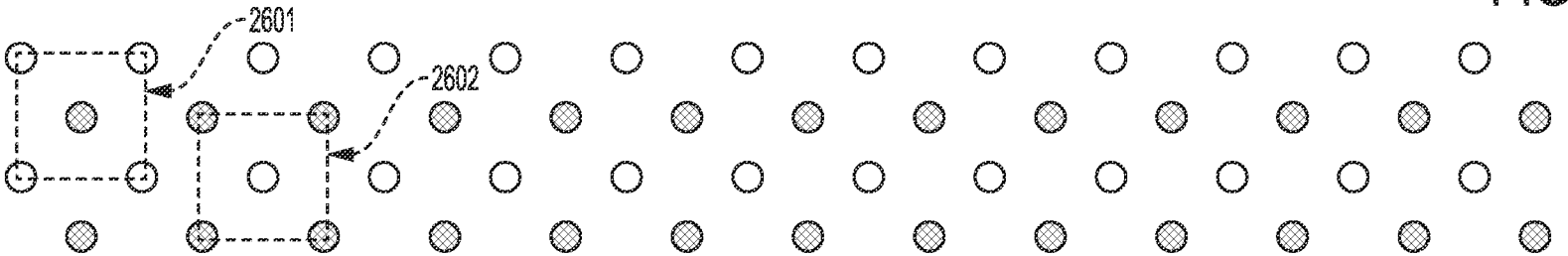
FIG. 26 depicts a support system with first supports in a first position and second supports in a second position.

FIG. 26 depicts a support system with first supports 2601 in a first position and second supports 2602 in a second position. As may be seen, the supports are arranged as squares surrounding opposite type supports. Again, alternation of vertical position allows mitigation of pressure sores.

Figure 27:
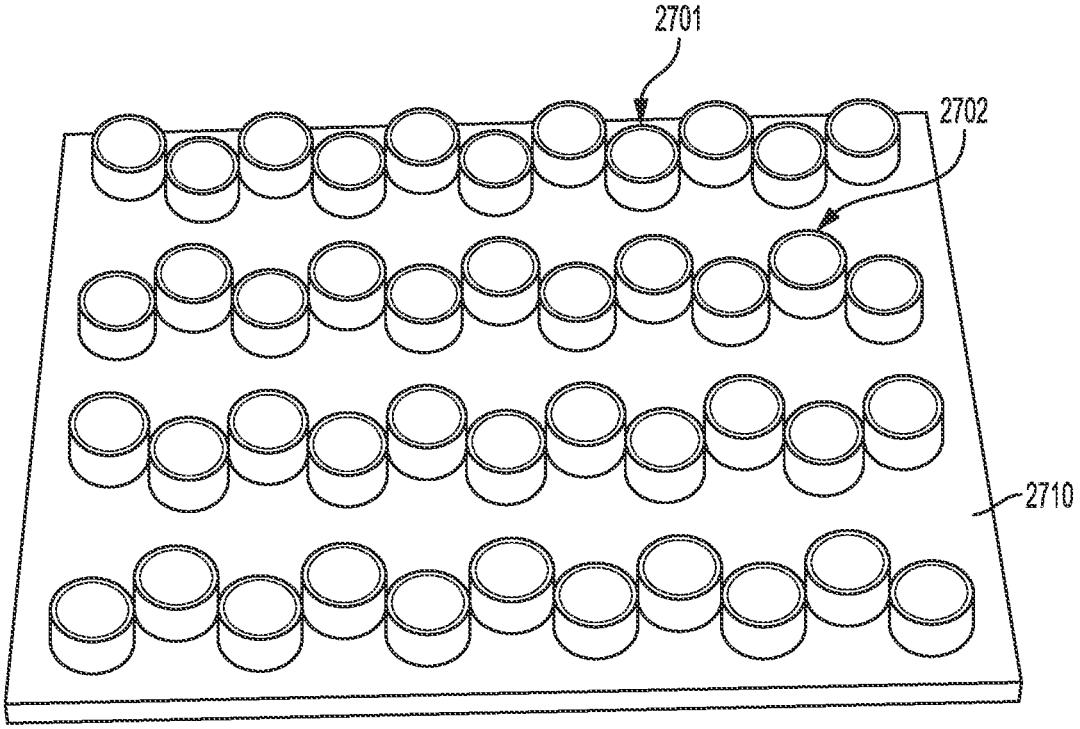
FIG. 27 depicts a support system with translating contacts.
Figure 28:
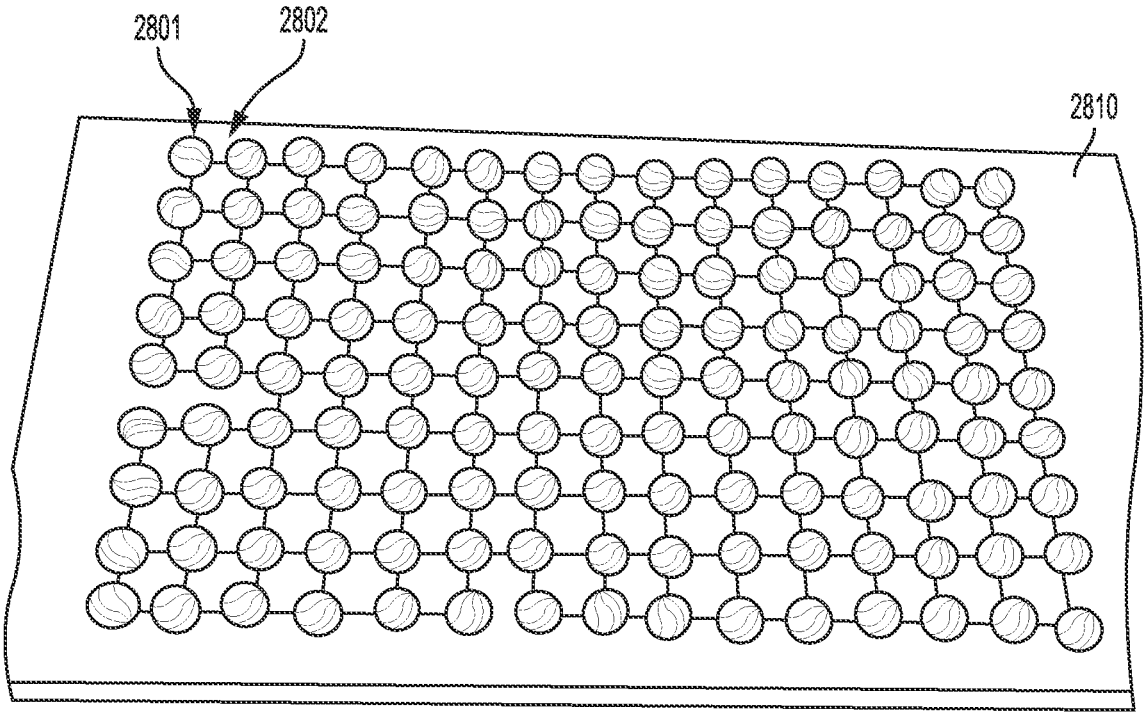
FIG. 28 depicts a support system with translating contacts.

Many other configurations of the present disclosure are possible. For instance, FIG. 27 depicts another support system with interrupted circle shapes of the supports 2701, 2702. FIG. 28 depicts a support system with contact beads 2801, 2802.

Figure 29:
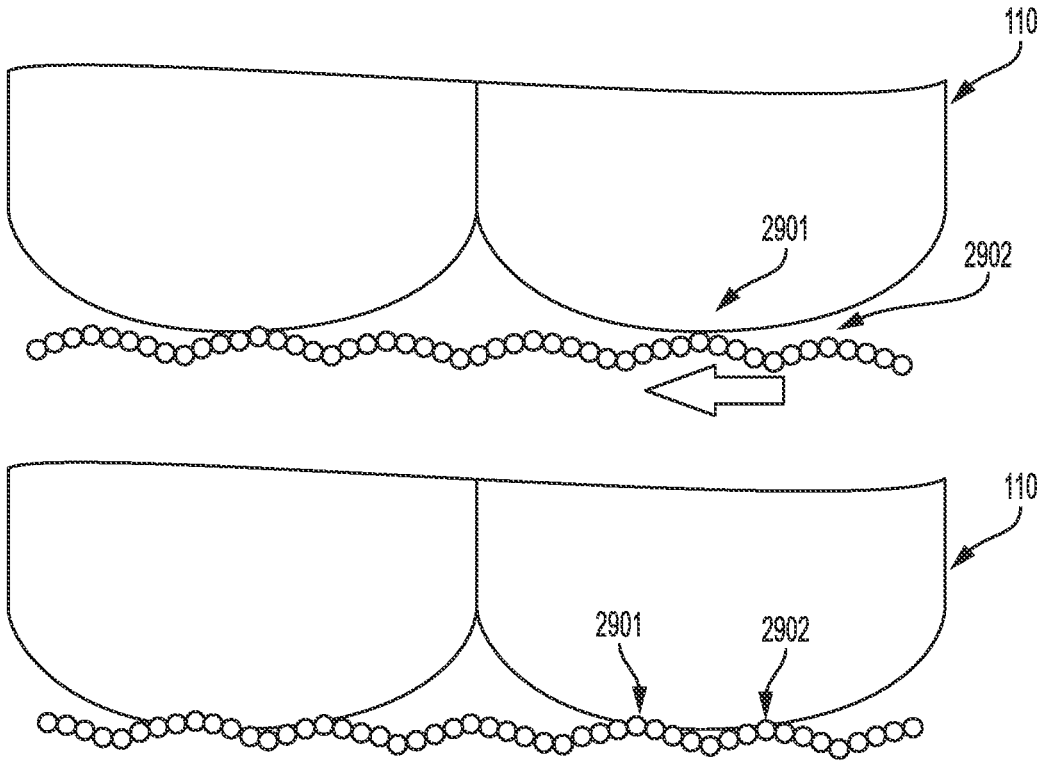
FIG. 29 depicts a support system with a wave of beads which may translate from front to back, left to right, or a combination thereof.
Figure 30:
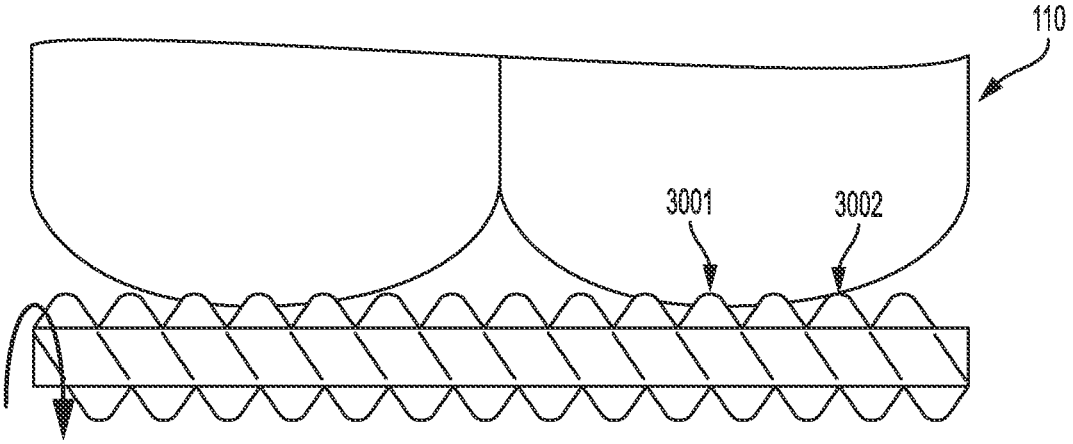
FIG. 30 depicts a support system with rotating roller supports.
Figure 31:
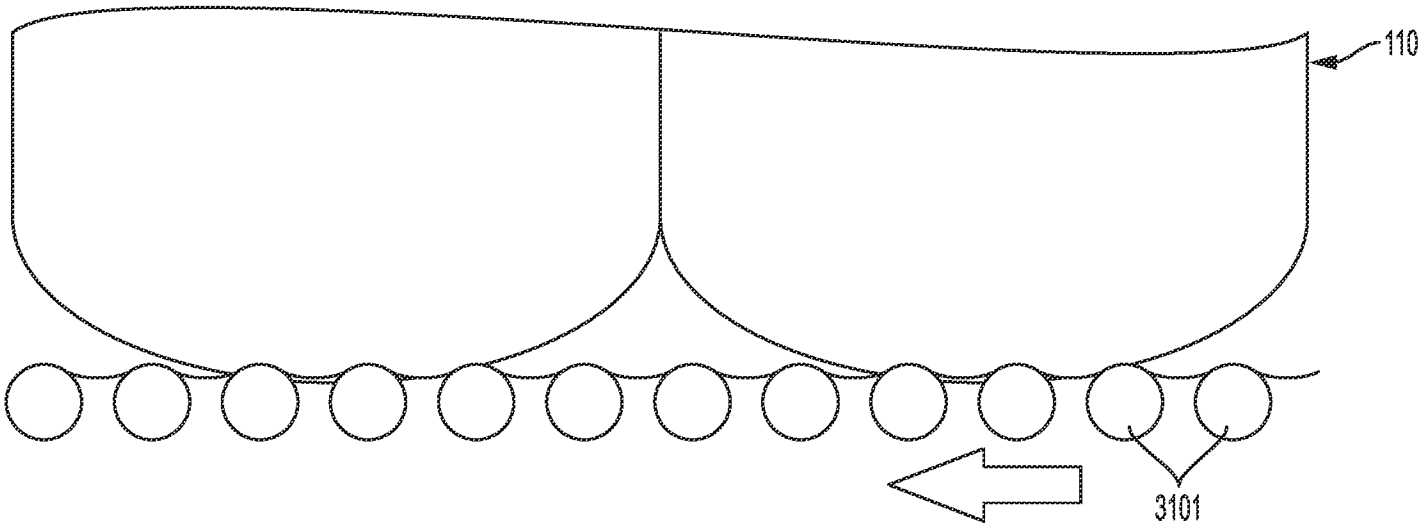
FIG. 31 depicts a support system with translating spheres for support.

In addition, horizontal translation of the supports may also be employed for a variety of applications. FIG. 29 depicts a support system with a wave of beads having peaks 2901, 2902 which may translate from front to back, left to right, or a combination thereof, so that either only one peak 2901 contacts the user (upper view) or both beaks 2901, 2902 contact the user (lower view). FIG. 30 depicts a support system with rotating roller supports having peaks 3001, 3202. As the roller rotates, the horizontal position of the peaks will move to the left or right. FIG. 31 depicts a support system with translating spheres 3101 for support. Applicant notes that horizontally moving supports may be less than ideal for certain applications, due to a shear force on the skin of a seated user.

Figures 32A, 32B, 32C:
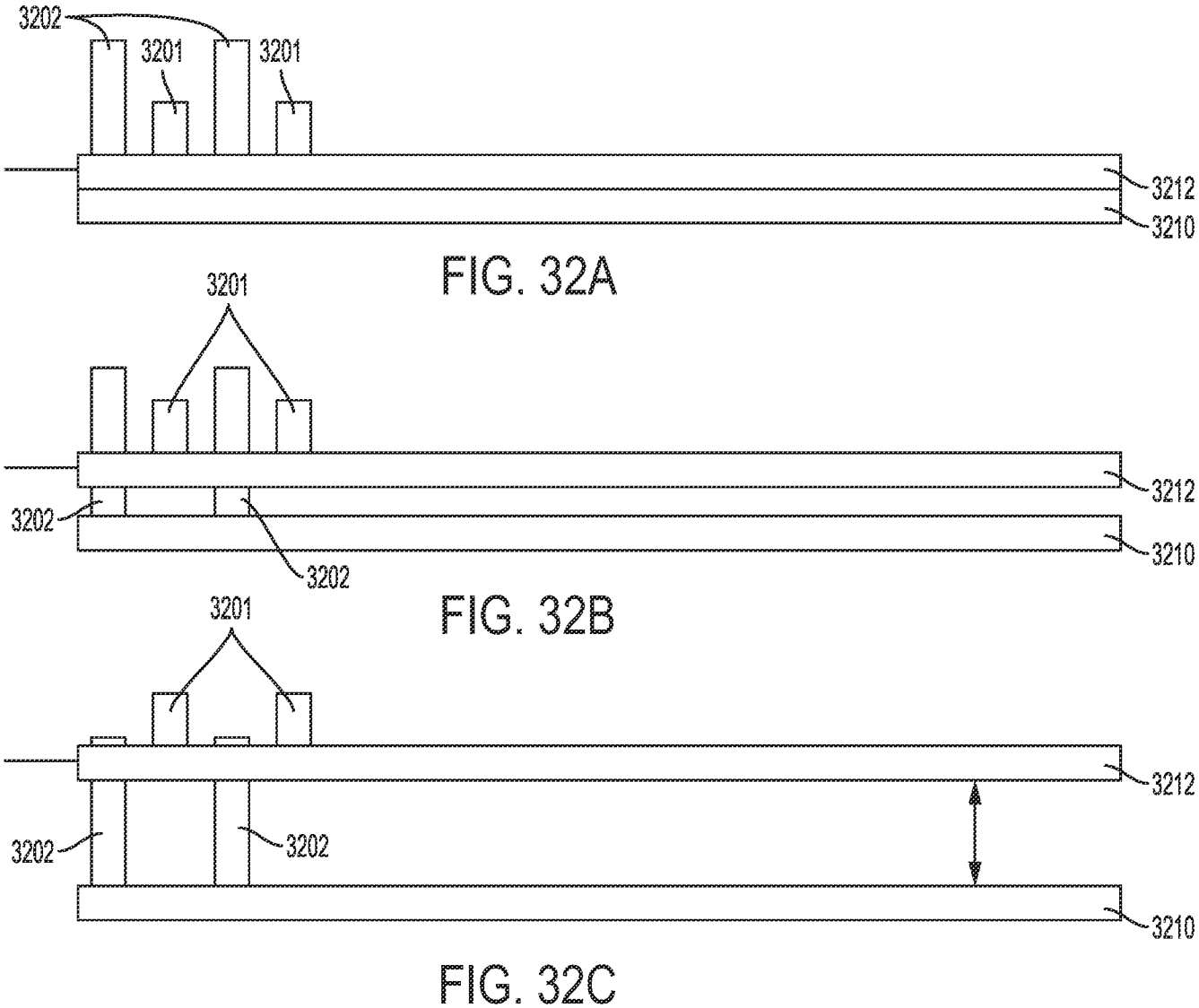
FIGS. 32A-32C depict, in cross-sectional elevation, a support system with translation of an upper and lower plates.

In addition, numerous other configurations of the present disclosure may be used to achieve the goal of reducing pressure sores, and are included herein to provide further examples of the broad scope of Applicant's discoveries. FIGS. 32A-32C depicts, in cross-sectional elevation, a support system with translation of an upper plate 3212 and lower plate 3210. First supports 3202 are attached to lower plate 3210. Second supports 3201 are attached to upper plate 3212. FIG. 32A shows the support system in a first position in which the user is supported by supports 3202, FIG. 32B shows the support system in the process of the upper plate 3212 elevating, and FIG. 32C shows the support system in a third position in which the user is supported by supports 3201.

Figure 33:
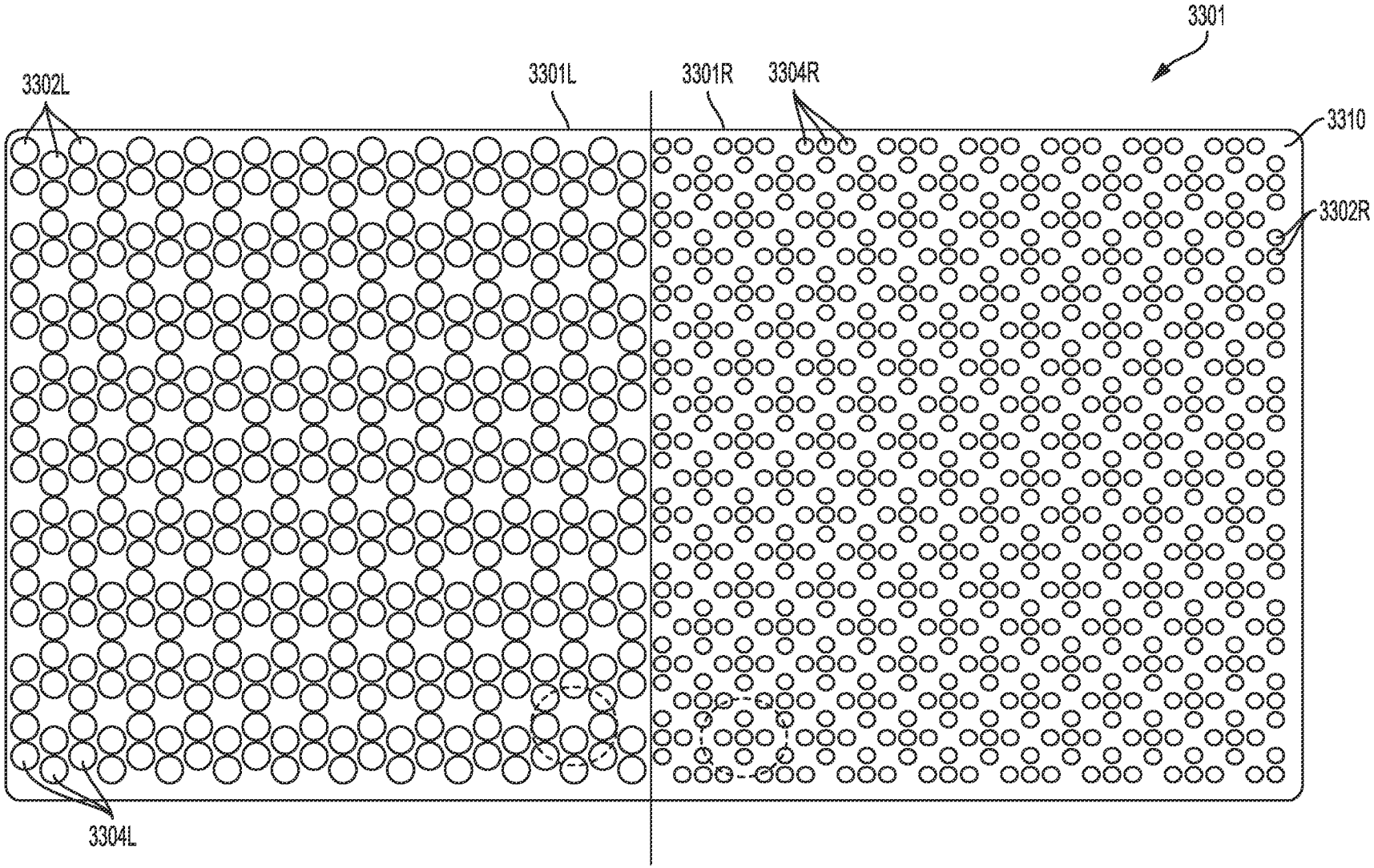
FIGS. 33-34 depict several views of a support system with upper and lower plates in which left and right sides of the support system have different patterns of supports.
Figure 34:
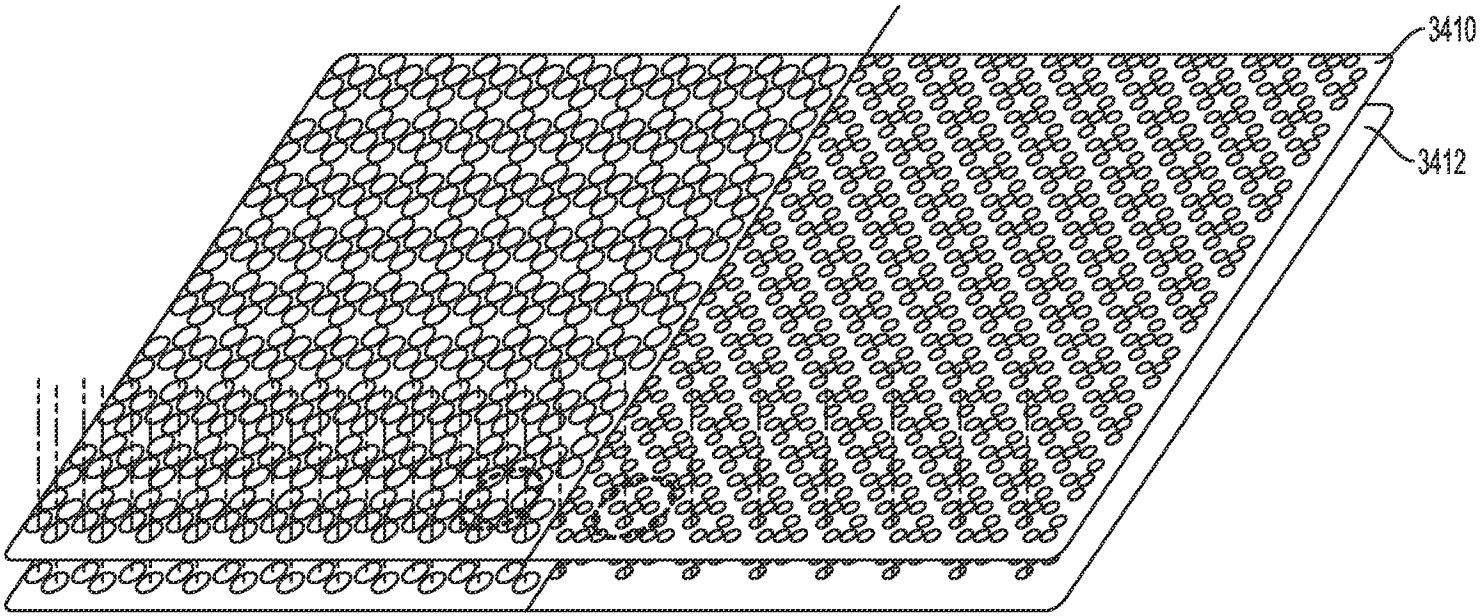

FIGS. 33-34 depict several views of a support system with upper plate 3410 and lower plate 3412 in which a left side 3301L and a right side 3301R of the support system have different patterns of supports, which combine the patterns of FIG. 28 and FIGS. 32A-32C. For example, on the left side, depicted are left first supports 3302L and left second supports 3304L. And on the right side, depicted are right first supports 3302R and right second supports 3304R. In a first position, the user may be supported by supports 3302L, 3302R, and in a second position, the user may be supported by supports 3304L, 3304R.

Figure 35:
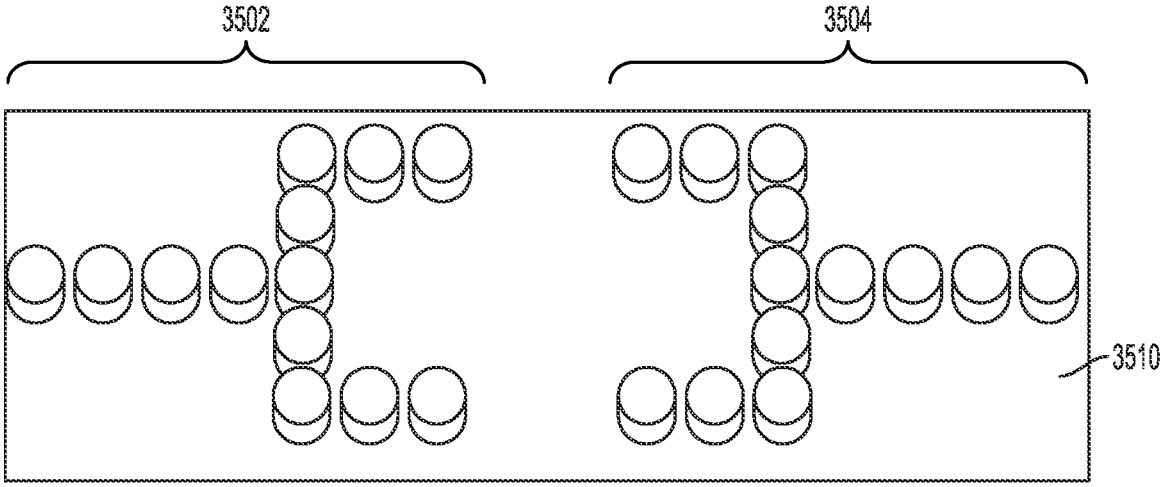
FIG. 35 depicts a pattern of supports for a support system.

FIG. 35 depicts a pattern of supports for a support system 3510, showing also the outlines of the supports 3502 and 3504 in which the pattern may be repeated along a wheelchair seat, and which may alternate between supports 3502, 3504 being in the upward and downward position to support the user. In addition, although not picture, a plus shaped arrangement of supports may be placed in between supports 3502, 3504, another plus shaped arrangement of supports to the left and right of supports 3502 and supports 3504, respectively, and the pattern repeated in two-dimensions. In such an example, supports 3502, 3504 may operate in tandem and alternately with the plus shaped arrangement of supports, to support the user in the wheelchair or seat.

Figure 36:
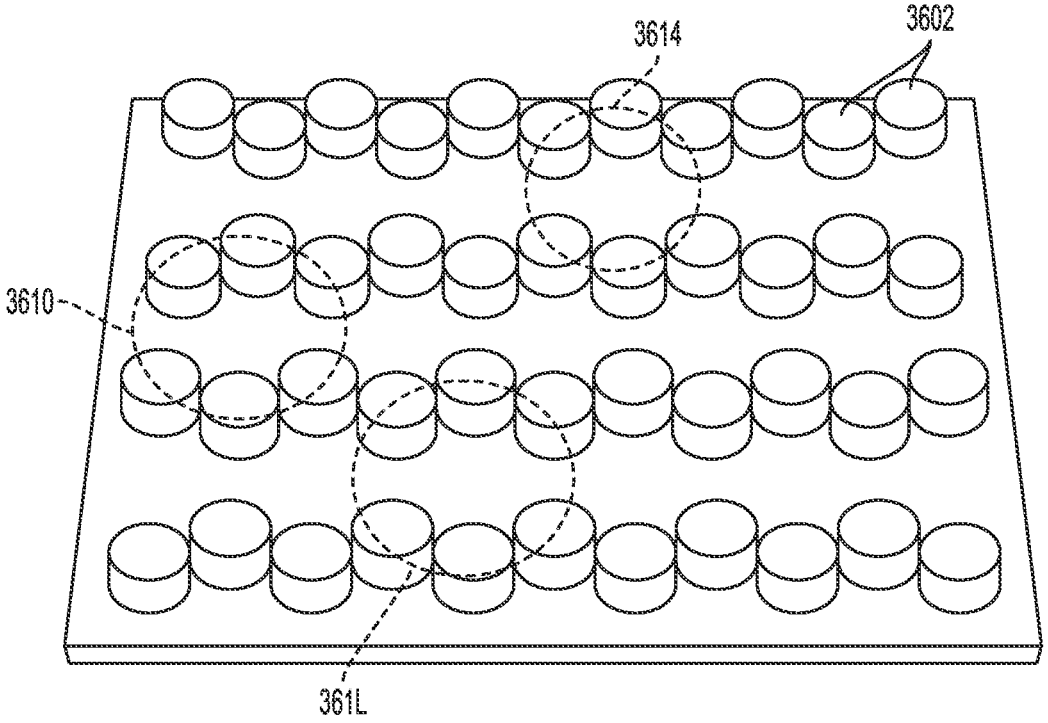
FIG. 36 depicts an interrupted shape support system.

FIG. 36 depicts a support system with supports 3602, showing the outlines of the interrupted circles 3610, 3612, 3614, where adjacent circles will alternate being in the upward and downward position to support the user.

Figure 37A:
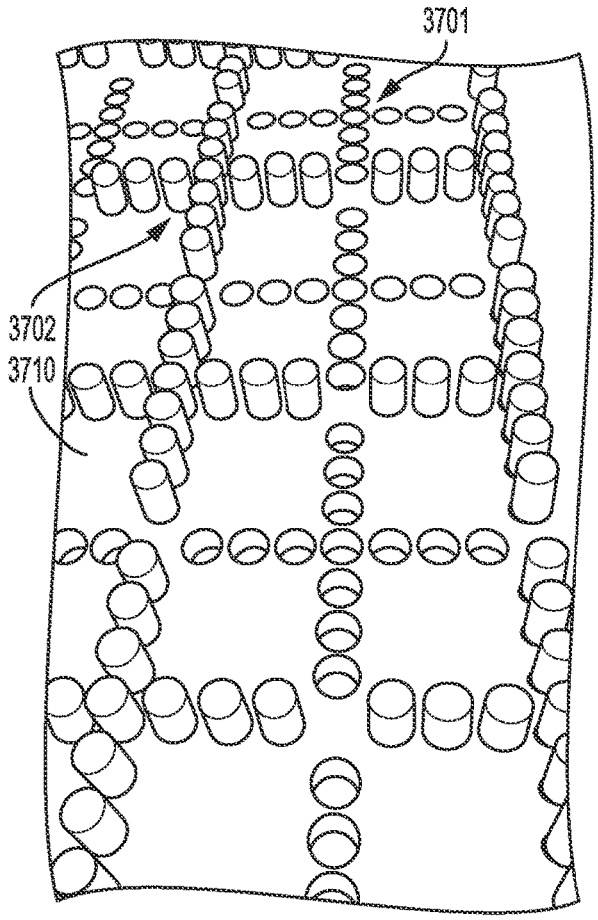
FIGS. 37A-37B depict a support system with interrupted shapes in two different positions.
Figure 37B:
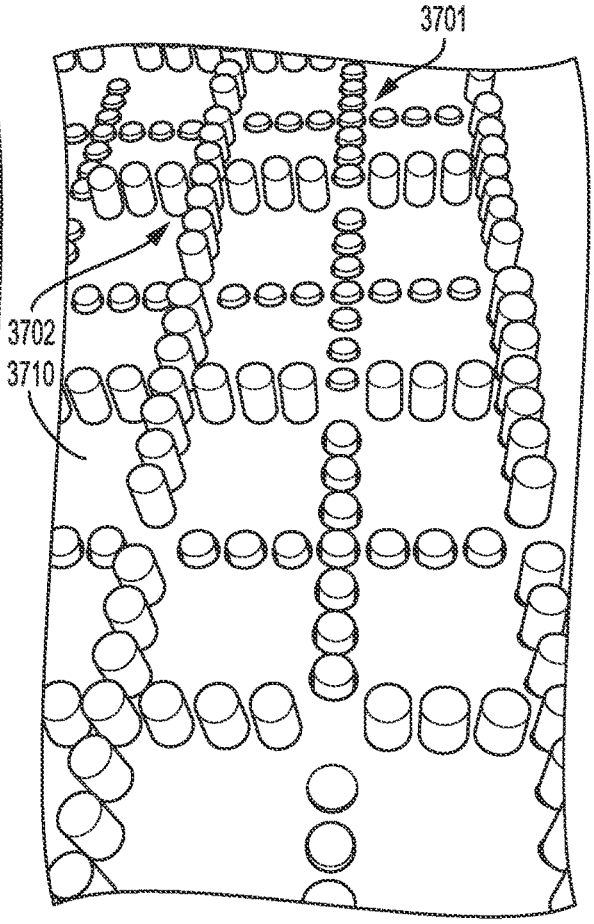

FIGS. 37A-37B depict a variation on the support system of FIG. 25 with cross shapes 3701, 3702 in two different positions, as seen in the FIG. 37A and FIG. 37B depictions.

Figure 38:
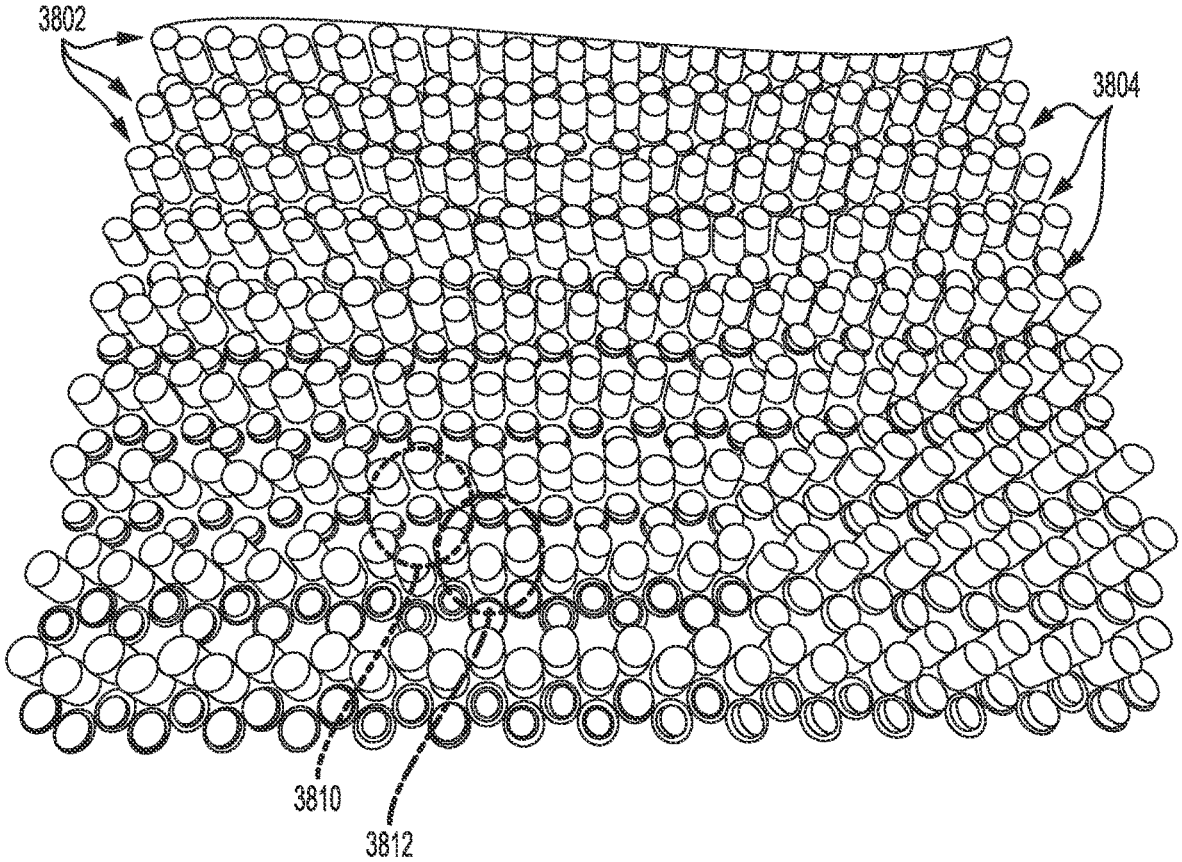
FIG. 38 depicts a three dimensional embodiment of the support system of FIG. 25, having upper and lower plates.

FIG. 38 depicts a three dimensional embodiment of the support system of FIG. 21, in which first supports 3802 alternate vertical position with second supports 3804. As may be seen, overlapping circles 3810, 3812 are also defined as in FIG. 21.

Figure 39A:
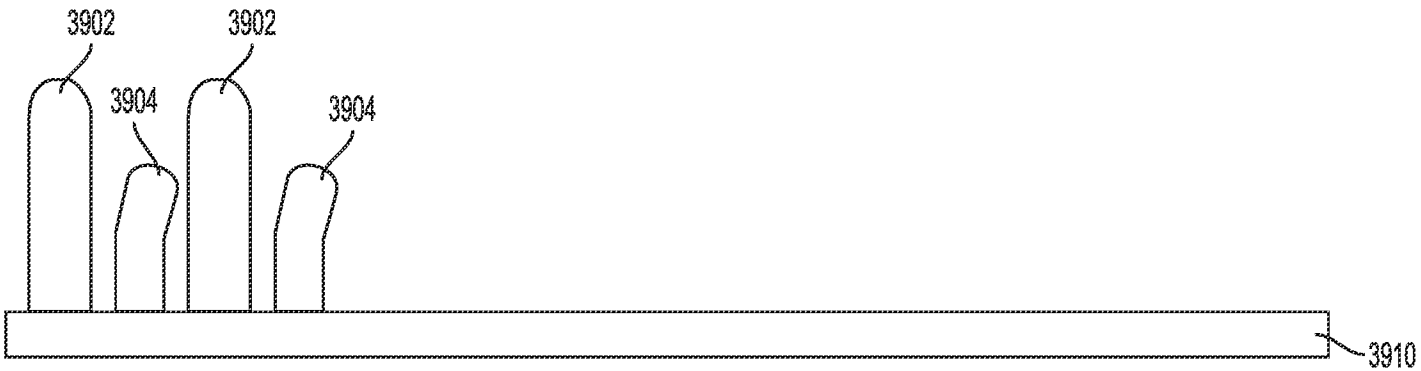
FIGS. 39A-39B depicts a pneumatic support system in two different positions.
Figure 39B:
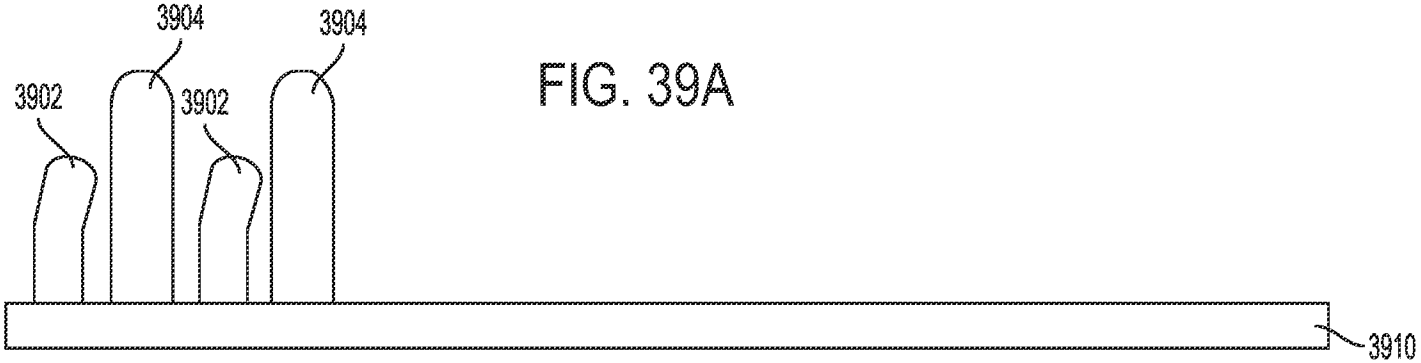

FIGS. 39A-39B depicts a pneumatic support system 3910 in two different positions. In FIG. 39A, the first supports 3902 including the first and third supports are uppermost, while second supports 3904 including the second and fourth supports are deflated. In FIG. 39B, the situation alternates, and the second supports 3904 have been inflated pneumatically and the first supports 3902 deflated. Again, these supports may be repeated in two dimensions using any of the two-dimensionally viewed patterns depicted above, allowing for mixing and matching patterns with actuation technology.

To the extent that the claims recite the phrase "at least one of" in reference to a plurality of elements, this is intended to mean at least one or more of the listed elements, and is not limited to at least one of each element. For example, "at least one of an element A, element B, and element C," is intended to indicate element A alone, or element B alone, or element C alone, or any combination thereof "At least one of element A, element B, and element C" is not intended to be limited to at least one of an element A, at least one of an element B, and at least one of an element C.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A wheelchair for supporting a user seated in the wheelchair, the wheelchair comprising:

an upper plate disposed in a seat area of the wheelchair;

a first group of supports for supporting the user, the first group of supports being attached to the upper plate and extending upwards therefrom;

a lower plate disposed below the upper plate;

a second group of supports for supporting the user, the second group of supports being attached to the lower plate and extending upwards therefrom and emerging through openings in the upper plate, wherein the first group of supports are vertically higher than the second group of supports and support the user when the upper plate is in a first position elevated above the lower plate, and the second group of supports are vertically higher than the first group of supports and support the user when the upper plate is in a second position closer to the lower plate than the first position, wherein the first group of supports are arranged along perimeters of shapes and the second groups of support are arranged inside or overlapping the perimeters of the shapes, the first group of supports being unevenly distributed along the perimeters of the shapes, and wherein the first group of supports have different spacing between some of the first group of supports compared to others of the first group of supports, and the second group of supports have different spacing between some of the second group of supports compared to others of the second group of supports; and an actuator for alternating the upper plate between the first position and the second position, wherein alternating supporting the user between the first supports in the first position and the second supports in the second position facilitates reducing or preventing ischemia or pressure sores of the user.

2. The wheelchair of claim 1, wherein at least some of the first group of the supports have different vertical positions relative to the upper plate.

3. The wheelchair of claim 1, wherein the supports comprise N groups of supports, and the wheelchair is configured to enable (N-x) of the groups of supports to support the user for a first time period, and a different (N-x) of the groups of supports to support the user for a second time period, wherein x may range from one to (N−1).

4. The wheelchair of claim 1, wherein the supports comprise pillars supported by springs.

5. The wheelchair of claim 1, wherein the supports comprise supports having a first width and supports having a second width.

* * * * *